US005500329A

United States Patent [19]

Kawai et al.

[11] Patent Number: 5,500,329

[45] Date of Patent: Mar. 19, 1996

[54] IMAGE FORMING METHOD EMPLOYING A SCANNING EXPOSURE

[75] Inventors: Kiyoshi Kawai, Minami Ashigara; Masami Hatori, Kanagawa, both of Japan

[73] Assignee: Fuji Photo Film Co., Ltd., Kanagawa, Japan

[21] Appl. No.: 366,373

[22] Filed: Dec. 29, 1994

Related U.S. Application Data

[63] Continuation of Ser. No. 59,979, May 13, 1993, abandoned.

[30] Foreign Application Priority Data

May 15, 1992 [JP] Japan ..... 4-148014

[51] Int. Cl.$^6$ ..... G03C 7/00; G03C 5/00; G03C 1/08; G03C 1/06

[52] U.S. Cl. ..... 430/363; 430/30; 430/508; 430/517; 430/394; 430/944; 430/945

[58] Field of Search ..... 430/30, 363, 394, 430/508, 517, 944, 945

[56] References Cited

U.S. PATENT DOCUMENTS

| | | | |
|---|---|---|---|
| 4,684,602 | 8/1987 | Lelental et al. | 430/363 |
| 4,892,804 | 1/1990 | Vincent et al. | 430/380 |
| 5,057,405 | 10/1991 | Shiba et al. | 430/945 |
| 5,126,235 | 6/1992 | Hidki | 430/363 |
| 5,153,110 | 10/1992 | Kawal et al. | 430/363 |
| 5,185,236 | 2/1993 | Shiba et al. | 430/363 |
| 5,190,854 | 3/1993 | Goedeweeck | 430/944 |
| 5,198,328 | 3/1993 | Shiba et al. | 430/363 |
| 5,244,776 | 9/1993 | Kawai | 430/363 |

FOREIGN PATENT DOCUMENTS

| | | | |
|---|---|---|---|
| 0539978 | 5/1993 | European Pat. Off. . | |
| 3141051 | 6/1988 | Japan | 430/363 |
| 3127026 | 5/1991 | Japan . | |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A method of forming an image in which a silver halide photographic material having on a waterproof resin coated support, which contains titanium dioxide in the resin, one or more light-sensitive layers each containing silver halide emulsion grains where at least one light-sensitive layer has been spectrally sensitized in accordance with the oscillating wavelength of a laser ray to be applied to the material is exposed by scanning exposure for a period of exposure time, per pixel, of $1\times10^{-7}$ second or less with a scanning exposure device equipped with an optical modulator capable of varying the quantity of light in plural stages, to form a photographic image. The quantity of the reflection light from the photographic material at the oscillating wavelength of the laser beam is 30% or less of the quantity of the incident light to the same. By the image forming method, a silver halide photographic material may be extremely rapidly exposed by scanning exposure and may be simply processed to give a photographic image in which the color density and the color tone in a pictorial image area do not differ from those of an image area of letters and thin lines.

9 Claims, 3 Drawing Sheets

IMAGE FORMING METHOD EMPLOYING A SCANNING EXPOSURE

This is a Continuation of application Ser. No. 08/059,979 filed May 13, 1993, now abandoned.

FIELD OF THE INVENTION

The present invention relates to a silver halide photographic material and to a scanning exposure method of forming an image on the material using high-density rays such as laser rays to rapidly obtain a hard copy.

BACKGROUND OF THE INVENTION

Recently, noticeable developments have taken place in the technologies of converting image data into electric signals and transmitting and storing data and of changing the layout or color tone of images and reproducing them on CRTs. With the development, the demand for hard copies from such image data is significantly increasing, and various hard copy means have been proposed. However, many of these means have a low image quality and, in particular, almost all color hard copies produced by such means are not good and are not comparable to prints made using the current generation of color papers. As one example of providing high-quality hard copies, there is Pictorography (trade name of Fuji Photo Film Co., Ltd.), which utilizes a silver halide heat-development dye-diffusion system and an LED scanning exposure system.

On the other hand, with development of the technology of silver halide photographic materials and a compact simple rapid development system for processing such materials (for example, mini-laboratory systems), photographic prints of extremely high quality can be provided easily and inexpensively in a short period of time. Regarding hard copies of stored images, the demand for high-quality hard copying materials which are inexpensive and which may be processed simply and rapidly to give stable and high-quality hard copies is extremely great.

As a system of obtaining hard copies from electric signals by the use of a silver halide photographic material, in general, a scanning exposure system of exposing the material while successively taking out image data from electric signals is employed, and a photographic material suitable for use in the system is needed. For the purpose of rapidly obtaining hard copies by the use of a silver halide photographic material, it is necessary to shorten both the time for scanning exposure and the time for development.

Various practical recording devices for scanning exposure are known. As light sources for recording with the devices, glow lamps, xenon lamps, mercury lamps, tungsten lamps and light emitting diodes and the like have heretofore been employed. However, all such light sources have such drawbacks for practical use that the output power is weak and the life is short so that they are not suitable to achieve the object of rapid scanning exposure. Scanning exposure devices capable of compensating for these drawbacks are known, in which coherent laser ray sources, for example, gas lasers such as a He—Ne laser, an argon laser or a He—Cd layer, semiconductor lasers, solid lasers, or secondary harmonic lasers to be obtained by combining such laser ray sources and non-linear optical materials are used as light sources for scanning exposure.

Gas lasers may yield a high output power but have the drawback that a large-scale and expensive device is needed.

As opposed to them, semiconductor lasers have such advantages that a small-size and inexpensive device may be employed, that a modulator is not needed since direct modulation is possible and that the life of semiconductor lasers is longer than that of gas lasers.

Because of these reasons, semiconductor lasers are often used in scanning exposure systems for printing photographic materials. The exposure device for the system is for dot exposure, and the modulation signals for it are those of binary information which may be controlled by an on-off change of a certain constant quantity of light. In the device, therefore, the minimum modulation time per pixel may be controlled within the range of about 20 ns. However, where an image with gradation like a hard copy is to be formed on a support, the quantity of light must be modulated in plural stages (of at least 6 bits or more, preferably 8 bits or more) so as to obtain a satisfactory image quality. The modulation methods for semiconductor lasers are grouped into an intensity modulation system where the current for the laser is changed to change the light intensity, and a pulse width modulation system where the exposure time per pixel is changed to change the quantity of light with the light intensity of the laser being constant. The two systems may be employed singly or in combinations of them. In the intensity modulation system, since the light intensity of the laser is varied, the quantity of heat to be generated is varied in accordance with the amount of exposure. Therefore, the light intensity can hardly be controlled, as compared with the pulse width modulation system. In addition, the controllable minimum time per pixel is longer in the intensity modulation system than in the pulse width modulation system. On the other hand, it is difficult to shorten the exposure time per pixel to less than several hundred nanoseconds in the pulse width modulation system because of the problem of the stability of modulation, at present. Where an A-4 size (210 mm×297 mm) hard copy is desired to be exposed with an image density of 400 dpi, exposure of about 15,000,000 pixels is needed. In such a case, even if one pixel is exposed in $5\times10^{-7}$ sec, the exposure of the hard copy of the A-4 size requires about 8 seconds, which is a great bar to the elevation of the copying speed.

Recently, due to advances in the technology of external modulators, waveguide acousto-optical modulators or waveguide electro-optical modulators have been developed, with which modulation at a rate of at most several ns per pixel has come to be possible. However, it has been found that application of such extreme short exposure to a silver halide photographic material causes differences in the density and the color tone between pictorial image areas with gradual density variation and image areas composed of fine lines such as computer graphics or letters, which cannot be observed in conventional scanning exposure.

On the other hand, if development is desired to be effected simply and rapidly, use of a silver halide emulsion having a high silver chloride content, such as that described in U.S. Pat. No. 4,892,804, is indispensable. However, it has been found that such a silver halide emulsion having a high silver chloride content brings about much more increase of the above-mentioned difference than a silver chlorobromide emulsion having a low silver chloride content or than a silver bromide emulsion. In addition, if the time for development is desired to be shortened, using an emulsion having a high silver chloride content, the difference increases even more.

Therefore, in order to obtain hard copies of constant quality simply and rapidly, by exposing a photographic material having a silver halide emulsion having a high silver chloride content with an exposing device equipped with the above-mentioned high-speed modulator, it is necessary to develop a silver halide photographic material which hardly causes differences in the density and the color tone between the pictorial image area and the image area of letters and fine lines due to differences between the objective scenes.

SUMMARY OF THE INVENTION

An object of the present invention is to provide a photographic image forming method, in which a silver halide photographic material may be exposed by extremely rapid scanning exposure and may then be processed simply and rapidly to give a photographic image involving little variation of the density and the color tone due to variation of the objective scenes.

This object of the present invention has been attained by an image forming method, in which a silver halide photographic material having provided on a support light-sensitive layer(s) each containing silver halide emulsion grains where at least one light-sensitive layer has been spectrally sensitized in accordance with the oscillating wavelength of a laser beam to be applied thereto, the quantity of the reflected light from the photographic material at the oscillating wavelength of the laser beam being 30% or less of the quantity of the incident light to the same, is exposed for a period of exposure time of $1\times10^{-7}$ second or less with a scanning exposure device equipped with an optical modulator capable of varying the quantity of light in plural stages.

This object of the present invention may also been attained by an image forming method, in which a silver halide color photographic material having at least three different silver halide light-sensitive layers each having a different color-sensitivity and each containing any of yellow, magenta or cyan-coloring couplers on a support where the silver halide emulsion in at least one light-sensitive layer is a high silver chloride emulsion having a silver chloride content of 95 mol % or more and having been spectrally sensitized in accordance with the oscillating wavelength of a laser beam to be applied to the material, the quantity of the reflection light from the photographic material at the oscillating wavelength of the laser beam being 30% or less of the quantity of the incident light to the same, is exposed for a period of exposure time of $1\times10^{-7}$ second or less with a scanning exposure device equipped with an optical modulator capable of varying the quantity of light in plural stages and then subjected to color development.

As one preferred embodiment of the present invention, the high silver chloride emulsion having a silver chloride content of 95 mol % or more and having been spectrally sensitized in accordance with the oscillating wavelength of a laser beam to be applied to the material has a localized silver bromide phase.

As another preferred embodiment of the present invention, the high silver chloride emulsion grains have been doped with $10^{-9}$ mol or more, per mol of silver halide of the emulsion, of at least one ion selected from metal ions (including metal complex ions) of Group VIII of the Periodic Table, metal ions of Group IIb, lead ion and thallium ion.

As still another preferred embodiment of the present invention, the exposure time for exposing the material with a scanning exposure device equipped with an optical modulator capable of varying the quantity of light in plural stages is $5\times10^{-8}$ second or less per pixel.

As still another preferred embodiment of the present invention, the optical modulator is a waveguide acousto-optical modulator or a waveguide electro-optical modulator.

As still another preferred embodiment of the present invention, the time for color development is 25 seconds or less and the total processing time from color development to drying is 90 seconds or less.

Figure 1:
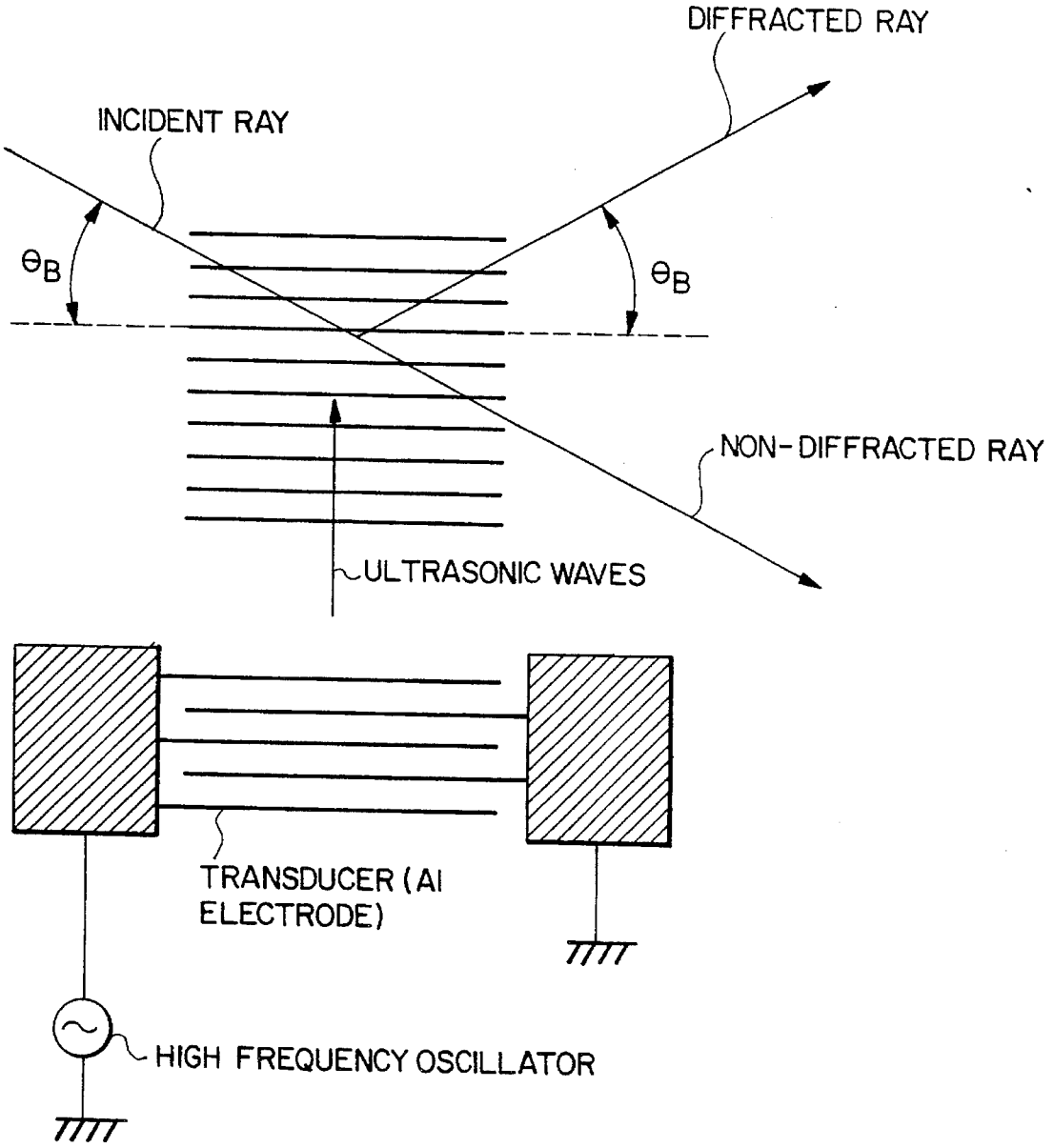
FIG. 1 is a conceptional view showing the principle of modulation of an acousto-optical modulator.

In the drawings, 10 is an image forming device body; 12 is a development tank; 14 is a bleach-fixation tank, 16 is a rinsing tank, 17 is a squeezing zone, 18 is a drying zone, 20 is a photographic material; 30 is a processing solution jetting part, 32 is a pump; 240 is an image processing device; 242, 244 and 246 each are a driving circuit; 251, 252 and 253 each are a semiconductor laser; 258, 259 and 260 each are a collimator lens; 261 is a total reflection mirror; 262 and 263 each are a dichromic mirror; 270 is a polygon mirror; 280 is an fθ lens; and 300 is an exposure device.

DETAILED EXPLANATION OF THE INVENTION

The present invention will be explained in detail hereunder.

The reflectivity of the silver halide photographic material of the present invention is explained below. It is necessary that the reflectivity of the material at the oscillation wavelength of the laser to be used for exposure of the material be 30% or less. Where a silver halide photographic material having a reflectivity of 30% or less is exposed for a shorter period of time than $1\times10^{-7}$ second per pixel by multi-stage exposure to take a picture of a varying scene, rapid formation of a stable image having a reduced difference in the density and a reduced variation of the color tone is possible, corresponding well to the varying objective scene. If, on the contrary, a photographic material having a reflectivity of more than 30% is exposed for a shorter period of time than $1\times10^{-7}$ second per pixel in accordance with the method of the present invention, the variation of the density of the image formed due to variation of the objective scene is large and the image is of no practical use. If an exposure device for an exposure period of time longer than $1\times10^{-7}$ second per pixel is employed for exposing a silver halide photographic material, the phenomenon is not seen irrespective of the reflectivity of the material. However, such a long exposure time does not satisfy the object of the present invention to rapidly obtain a hard copy. Therefore, the object of the present invention to rapidly obtain a stable image having a reduced difference in the density and a reduced variation of the color tone from a varying objective scene may be attained only when a silver halide photographic material having a reflectivity of 30% or less is exposed for a shorter period of time than $1\times10^{-7}$ second per pixel.

Measurement of the reflectivity of the photographic material for use in the present invention may be effected by the use of an ordinary reflection densitometer, and the reflectivity of the photographic material is defined as follows:

$$\text{Reflectivity}=[F(\lambda)/F_0(\lambda)]\times100$$

where $F_0(\lambda)$ is the quantity of the reflected light from a standard white plate at a wavelength of $\lambda$ nm; and $F(\lambda)$ is the quantity of the reflected light from the sample at a wavelength of $\lambda$ nm.

As a means for making the reflectivity of the photographic material at the oscillation wavelength of the laser to be used for exposure of the material fall within the range of 30% or less, preferably employed is a method of adding a dye (e.g., oxonole dye, cyanine dye), which may decolor by processing, to the hydrophilic colloid layer of the material, as described in European Patent 0337490A2, pages 27 to 76. Also preferred for the means is use of a dye which is incorporated into the hydrophilic colloid layer in the form of a dispersion of fine solid grains of the dye and which decolor by development, such as the dyes described in JP-A-2-282244, from page 3, right top column to page 8 and the dyes described in JP-A-3-7931, from page 3, right top column to page 11, left bottom column. Where the dyes are employed for this purpose, those which have an absorption overlapping with the spectral sensitivity peak of the light-sensitive layer of the material are preferably selected.

However, some such water-soluble dyes would often worsen the color separation, if an increased amount of them is incorporated into the material. As dyes which may be used without worsening the color separation, water-soluble dyes as described in Japanese Patent Application Nos. 3-310143, 3-310189 and 3-310139 are preferred.

In addition, also preferred is incorporation of a colloidal silver into the outermost layer, as described in JP-A-1-239544.

As the silver halide emulsion for use in the present invention, preferred are high silver chloride grains having from 0.01 to 3 mol % of silver iodide on the surface of the grain, such as those described in JP-A-3-84545, for the purpose of elevating the sensitivity of high illuminance and the sensitivity of infrared spectral sensitization of the photographic material and of elevating the stability of the same. For the purpose of shortening the development time, silver chlorobromide or silver chloride substantially not containing silver iodide is also preferred. The wording "substantially not containing silver iodide" as used herein means that the silver iodide content in the silver halide is 1 mol % or less, preferably 0.2 mol % or less. Regarding the halogen composition of the grains constituting an emulsion for use in the present invention, the grains may have different halogen compositions. Preferably, however, the emulsion contains grains each having the same halogen composition, as the properties of the grains may easily be homogenized. Regarding the halogen composition distribution of the grains constituting a silver halide emulsion for use in the present invention, the grains may have a so-called uniform halogen composition structure where any part of a grain has the same halogen composition; or the grains may have a so-called laminate (core/shell) structure where the halogen composition of the core of a grain is different from that of the shell of the same; or the grains may have a composite halogen composition structure where the inside or surface of a grain has a non-layered different halogen composition part (for example, when such a non-layered different halogen composition part is on the surface of the grain, it may be on the edge, corner or plane of the grain as a conjugated structure). Any of such halogen compositions may properly be selected. In order to obtain a high sensitivity photographic material, the latter laminate or composite halogen composition structure grains are advantageously employed, rather than the first uniform halogen composition structure grains. Such laminate or composite halogen composition structure grains are also preferred in view of their pressure resistance. In the case of laminate or composite halogen composition structure grains, the boundary between the different halogen composition parts may be a definite one or may also be an indefinite one forming a mixed crystal structure because of the difference in the halogen compositions between the adjacent parts. If desired, the boundary between them may positively have a continuous structure variation.

For the photographic material of the present invention which is suitable for rapid processing, a so-called high silver chloride emulsion having a high silver chloride content is preferred. The silver chloride content in such a high silver chloride emulsion for use in the present invention is preferably 95 mol % or more, more preferably 97 mol % or more.

In such a high silver chloride emulsion, it is preferred that a silver bromide localized phase be located in the inside and/or surface of the silver halide grain in the form of a layered or non-layered structure. The halogen composition in the localized phase is preferably such that the silver bromide content therein is at least 10 mol % or more, more preferably more than 20 mol %. The localized phase may be in the inside of the grain or on the edges or corners of the surface of the grain. As one preferred embodiment, the localized phase may be epitaxially grown on the corner parts of the grain.

For the purpose of reducing the amount of the replenisher to the developer for processing the photographic material, it is also effective to further elevate the silver chloride content in the silver halide emulsion constituting the material. In such a case, an emulsion of an almost pure silver chloride having a silver chloride content of from 98 mol % to 100 mol % is preferably used.

The silver halide grains constituting the silver halide emulsion of the present invention may have a mean grain size of preferably from 0.1μ to 2μ. (The grain size is defined as the diameter of a circle having an area equivalent to the projected area of the grain, and the mean grain size is defined as the number average value to be obtained from the measured grain sizes.)

Regarding the grain size distribution of the emulsion, a so-called monodispersed emulsion having a coefficient of variation (to be obtained by dividing the standard deviation of the grain size distribution by the mean grain size) of 20% or less, preferably 15% or less is preferred. For the purpose of obtaining a broad latitude, two or more monodispersed emulsions may be blended to form a mixed emulsion for one layer, or they may be separately coated to form plural layers. Such blending or separate coating is preferably effected for this purpose.

Regarding the shape of the silver halide grains constituting the silver halide emulsion of the present invention, the grains may be regular crystalline ones such as cubic, tetradecahedral or octahedral crystalline grains, or irregular crystalline grains such as spherical or tabular crystalline grains, or may be composite crystalline grains composed of such regular and irregular crystalline forms. The emulsion may also be composed of grains of different crystalline forms. Above all, the emulsion of the present invention preferably contains regular crystalline grains in a proportion of 50% or more, preferably 70% or more, more preferably 90% or more.

In addition to them, also preferably employable is an emulsion containing tabular grains having a mean aspect ratio (circle-corresponding diameter/thickness) of 5 or more, preferably 8 or more, in an amount of more than 50%, as the projected area, of all the grains in the emulsion.

The silver chlorobromide emulsion for use in the present invention can be produced by various known methods, for example, by the methods described in P. Glafkides, *Chemie et Phisique Photographique* (published by Paul Montel, 1967); G. F. Duffin, *Photographic Emulsion Chemistry* (published by Focal Press, 1966); and V. L. Zelikman et al., *Making and Coating Photographic Emulsion* (published by Focal Press, 1964). Briefly, any known acid method, neutral method or ammonia method may be employed. As a system of reacting a soluble silver salt and soluble halide(s), any known single jet method, double jet method or combination of them may be employed. A so-called reverse mixing method of forming grains in an atmosphere having excess silver ions may also be employed. As one system of a double jet method, a so-called controlled double jet method of keeping the pAg value constant in the liquid phase while forming silver halide grains may also be employed. In accordance with the method, an emulsion of silver halide grains each having a regular crystalline form and an almost uniform grain size may be obtained.

The localized phase and the host phase of each of the silver halide grains of the present invention preferably contains hetero metal ion(s) or complex ion(s). Preferred ions for this purpose are selected from those belonging to Group VIII and Group IIb of the Periodic Table and complex ions of them and lead ion and thallium ion. Mainly, the localized phase contains metal ion(s) or complex ion(s) of iridium, rhodium and iron and optionally a combination thereof; and the host phase contains metal ion(s) or complex ion(s) of osmium, iridium, rhodium, platinum, ruthenium, palladium, cobalt, nickel and iron and optionally a combination thereof. The kind and the concentration of the metal ion(s) may be different as between the localized phase and the host phase. Plural kinds of such metals may be in the phases.

The silver halide emulsion to be in the photographic material of the present invention which is exposed by scanning exposure with laser rays must be suitable to high illuminance exposure and must have gradation capable of yielding the necessary density by a controlled exposure range with laser rays. If infrared semiconductor laser rays are employed for the exposure, the material must have been subjected to infrared spectral sensitization. Since the stability of infrared sensitizing dyes is extremely bad in the photographic material of the present invention, the storage stability of the material must be improved. For this purpose, incorporation of iridium, rhodium, ruthenium or iron ion or complex ions into the material is extremely advantageous. The amount of the metal ion or complex ion to be in the material varies greatly, depending upon the the base of the silver halide emulsion to be doped with the ion, the grain size of the grains of the emulsion and the doping position of the grains. For instance, the content of iridium and rhodium ions is individually preferably from $5\times10^{-9}$ mol to $1\times10^{-4}$ mol per mol of silver; and that of iron ion is preferably from $1\times10^{-7}$ mol to $5\times10^{-3}$ mol per mol of silver.

Compounds capable of donating the metal ions are added to the aqueous gelatin solution which acts as a dispersion medium or to the aqueous halide solution, the aqueous silver salt solution or other aqueous solutions prior to formation of the silver halide grains, or alternatively, fine silver halide grains previously containing the intended metal ion(s) may be added to the silver halide grains during formation of the grains, whereby the intended metal ion(s) or complex ion(s) may be incorporated into the localized phase and/or the other phase (e.g., the host phase) of the silver halide grains of the present invention.

Incorporation of the metal ion(s) or complex ion(s) into the emulsion grains of the present invention may be effected at any time before the formation of the grains, during the formation of the grains or just after the formation of the grains. The time may be selected in accordance with the position of the grain to which the metal ion is to be incorporated.

The silver halide emulsion of the present invention is, in general, chemically sensitized or spectrally sensitized.

Suitable methods of chemical sensitization include chalcogen sensitization (for example, sulfur sensitization to be effected by adding an unstable sulfur compound, selenium sensitization with a selenium compound, tellurium sensitization with a tellurium compound), noble metal sensitization such as gold sensitization, or reduction sensitization, or combinations of them. As compounds to be used for such chemical sensitization, preferred are those described in JP-A-62-215272, from page 18, left bottom column to page 22, right top column.

The emulsion of the present invention is a so-called surface latent image type emulsion capable of forming a latent image essentially on the surfaces of the grains therein.

The silver halide emulsion of the present invention may contain various compounds as well as precursors of them, for the purpose of preventing fog of photographic materials or of stabilizing the photographic properties of them, during manufacture, storage or processing of them. Specific examples of compounds preferably usable for these purposes are described in JP-A-62-215272, from page 39 to page 72. In addition, compounds described in EP0447647 are also preferably employed.

Spectral sensitization is effected for the purpose of making the respective emulsion layers constituting the photographic material of the present invention sensitive to the desired light wavelength range. The method of the present invention employs monochromic high-density rays, such as laser rays or secondary harmonic laser rays derived from a laser and a non-linear optical material, as a light source for exposure. Therefore, the photographic material to be processed by the method of the present invention must be spectrally sensitized in accordance with the oscillation wavelength of the rays. Spectral sensitization "in accordance with" the oscillation wavelength of the rays means that the photographic material is spectrally sensitized with a sensitizing dye having an optical sensitivity at the oscillation wavelength, but it does not always mean that the spectral sensitivity peak of the sensitized material is equal to the oscillation wavelength. From the viewpoint of the sensitivity of the photographic material to the laser rays and of the color separation of the material, it is preferred that the oscillation wavelength is equal to the spectral sensitivity wavelength peak. However, for the purpose of reducing the variation of the oscillation wavelength of laser rays due to variation of the ambient temperature and of reducing the variation of the sensitivity of the photographic material due to fluctuation of the oscillated light intensity, it is also preferred to intentionally make the oscillation wavelength and the spectral sensitivity wavelength peak different from each other. In particular, it is preferred to make the wavelength of the spectral sensitivity peak of the photographic material longer than the oscillation wavelength of laser rays. As examples of spectrally sensitizing dyes usable for spectral sensitization of the photographic material of the present invention, mentioned are those as described in F. M. Harmer, *Heterocyclic Compounds—Cyanine Dyes and Related Compounds* (published by John Wiley & Sons Co., New York, London, 1964). Specific examples of preferably usable compounds as well as spectral sensitization methods with them are described in JP-A-62-21572, from page 22, right top column to page 38.

Where semiconductor lasers are used as a light source for scanning exposure of the photographic material of the present invention, the material must be efficiently spectrally sensitized in the range of from red to infrared. In particular, for the purpose of spectrally sensitizing the material in the range of 730 nm or more, use of the sensitizing dyes as described in JP-A-3-15049, from page 12, left top column to page 21, left bottom column; JP-A-3-20730, from page 4, left bottom column to page 15, left bottom column; EP-0,420,011, from page 4, line 21 to page 6, line 54; EP-0,420,012, from page 4, line 12 to page 10, line 33; and EP-0,443,466 and U.S. Pat. No. 4,975,362 is preferred. The sensitizing dyes are relatively chemically stable and adsorb to the surfaces of silver halide grains relatively strongly and are characterized in that the dyes are difficult to desorb from the surfaces of silver halide grains even when the dispersion of couplers or the like is present in the emulsion along with the grains. Of the dyes for infrared sensitization, especially preferred are those having a reduction potential of −1.05 (V vs SCE) or lower. More preferred are those having a reduction potential of −1.15 or lower. Sensitizing dyes having these characteristics are advantageous for elevating the sensitivity of the material, especially for stabilizing the sensitivity of the material and for stabilizing the latent image formed.

Measurement of the reduction potential may be effected by means of phase discriminating secondary harmonic alternating current polarography, in which a dropping mercury electrode is used as the working electrode, a saturated calomel electrode is used as the reference electrode, and a platinum electrode is used as the counter electrode.

Measurement of the reduction potential by phase discriminating secondary harmonic alternating current voltammetry using a platinum electrode as the working electrode is described in Journal of Imaging Science, Vol. 30, pp. 27–35 (1986).

Where the spectrally sensitizing dye is incorporated into a silver halide emulsion, it may be added directly to the emulsion, or alternatively, it may be first dissolved in a single solvent or mixed solvent of water, methanol, ethanol, propanol, methyl cellosolve and/or 2,2,3,3-tetrafluoropropanol and thereafter the resulting solution may be added to the emulsion. In addition, it is also possible to form an aqueous solution of the dye in the presence of an acid or base, as so described in JP-B-44-23389, JP-B-44-27555 and JP-B-57-22089, or to form an aqueous solution or colloidal dispersion in the presence of a surfactant as so described in U.S. Pat. Nos. 3,822,135 and 4,006,025; and the resulting solution or dispersion may be added to the emulsion. Further, it is also possible to dissolve the dye in phenoxyethanol or a solvent which is substantially immiscible in water, then to disperse the resulting solution in water or a hydrophilic colloid; and the resulting dispersion may be added to the emulsion. Further, the dye may also be dispersed directly in a hydrophilic colloid, as so described in JP-A-53-102733 and JP-A-58-105141, and the resulting dispersion may be added to the emulsion. The time of adding the dye to the emulsion may be any time which has heretofore been said useful in preparing photographic emulsions. Specifically, the time may be selected from any of before the formation of silver halide grains, during the formation of the grains, immediately after the formation of the grains to before the rinsing of the grains, before the chemical sensitization of the grains, during the chemical sensitization of the grains, immediately after the chemical sensitization of the grains to before the cooling and solidification of the grains, and during the preparation of the coating composition containing the grains. Most generally, addition of the dye is effected at any time after completion of the chemical sensitization of the emulsion and before coating it. If desired, the dye may be added to the emulsion at the same time of adding a chemical sensitizing agent thereto so as to effect spectral sensitization and chemical sensitization simultaneously, as so described in U.S. Pat. Nos. 3,628,969 and 4,225,666; or spectral sensitization may be effected prior to chemical sensitization as so described in JP-A-58-113928; or the dye may be added before completion of formation of precipitates of silver halide grains to start the spectral sensitization prior to formation of the grains. In addition, it is also possible to stepwise partially add the spectrally sensitizing dye as so described in U.S. Pat. No. 4,225,666; or that is, a part of the dye is added prior to chemical sensitization of the emulsion and the remaining part thereof is then added after the chemical sensitization of the emulsion. In general, addition of a spectrally sensitizing dye to an emulsion may be effected at any and every stage of forming silver halide grains of the emulsion by any and every known method, for example, the methods as taught in U.S. Pat. No. 4,183,756 may be employed. Especially preferably, the dye is added to an emulsion before rinsing it with water or before chemical sensitization of the emulsion.

The amount of the spectrally sensitizing dye to be added to the emulsion may vary broadly, and preferably it is from $0.5\times10^{-6}$ mol to $1.0\times10^{-2}$ mol, more preferably from $1.0\times10^{-6}$ mol to $5.0\times10^{-3}$ mol, per mol of silver halide.

Especially when the photographic material of the present invention is spectrally sensitized with sensitizing dyes having a spectral sensitivity in the range of from red to infrared, the compounds described in JP-A-2-157749, from page 13, right bottom column to page 22, right bottom column are preferably employed. Using these compounds, the storage stability of the photographic material, the stability of the material during processing of it and the supersensitization of the material may be elevated. Above all, use of the compounds of formulae (IV), (V) and (VI) as described in JP-A-2-157749 along with red or infrared sensitizing dyes is especially preferred. The amount of the compound to be used for this purpose is from $0.5\times10^{-5}$ mol to $5.0\times10^{-2}$ mol, especially preferably from $5.0\times10^{-5}$ mol to $5.0\times10^{-3}$ mol, per mol of silver halide in the photographic material; and it is advantageously from 1 to 10,000 times, preferably from 2 to 500 times greater than the amount of the sensitizing dye on a molar basis.

The constitution of the photographic material of the present invention will be explained further below. The photographic material of the present invention has at least one silver halide emulsion layer on a support and may form an image by scanning exposure with laser rays. For obtaining a color image, the material must have at least three silver halide emulsion layers on the support. The photographic material of the present invention is applied to scanning exposure with monochromic high-density rays from, for example, a gas laser, a semiconductor laser device (LD), a solid laser using a semiconductor laser as an exciting light source, a second harmonic generation (SHG) light source comprising a combination of a semiconductor laser and non-linear optical crystals, or the like. In order to make the exposing system compact and inexpensive, use of a semiconductor laser device (LD), a solid laser using a semiconductor laser as an exciting light source, or a second harmonic generation (SHG) light source comprising a combination of a semiconductor laser and non-linear optical crystals is preferred. In particular, for the purpose of planning an exposing device which is compact and inexpensive and which has a long life and high stability, use of a semiconductor device is especially preferred. In general, use of a semiconductor laser is desired as at least one light source for exposure of the photographic material of the present invention.

The spectral sensitivity peak of the photographic material of the present invention may freely be defined in accordance with the wavelength of the light source for scanning exposure of the material. Regarding the solid laser using a semiconductor laser as an exciting light source or the SHG light source comprising a combination of a semiconductor laser and non-linear optical crystals, the oscillating wavelength from the laser may be made to be halved. Therefore, from the laser, a blue light and a green light may be obtained. Accordingly, the spectral sensitivity peak of the photographic material of the present invention may be in any one of three general ranges of blue, green and red. Where a semiconductor laser only is used as a light source for scanning exposure of the photographic material of the present invention in order that the exposing device may be an inexpensive, stable and compact one, it is desired that at least two layers of the material each have a spectral sensitivity peak at 670 nm or more. This is because the light emitting wavelength range of currently available inexpensive and stable semiconductor lasers of Groups III to V is only in the range of from red to infrared. However, in the laboratory, oscillation of semiconductor lasers of Groups II to VI in the range of from green to blue has been proven. Therefore, the possibility of inexpensive and stable use of such semiconductor lasers would sufficiently be anticipated after further development of the technology of producing improved semiconductor lasers. In this possible case, the necessity of having at least two layers of the photographic material each having a spectral sensitivity peak at 670 nm or more would be small.

Preferably, the light-sensitive layers of the photographic material of the present invention each contain at least one coupler capable of coloring by a coupling reaction with an oxidation product of an aromatic amine compound. As a photographic material for full color hard copies, it is preferred that the material have at least three silver halide light-sensitive layers each having a different spectral sensitivity on a support and that each layer contain any one of yellow, magenta and cyan couplers capable of coloring by a coupling reaction with an oxidation product of an aromatic amine compound. The three kinds of different spectral sensitivities may be freely selected in accordance with the wavelength range of the light source to be .used for digital exposure. It is desired that the nearest adjacent spectral sensitivity peaks be separated from each other by at least 30 nm. The relationship between the couplers (Y, M, C) to be contained in each of at least the three light-sensitive layers ($\lambda 1$, $\lambda 2$, $\lambda 3$) each having a different spectral sensitivity peak and the corresponding three light-sensitive layers is not specifically defined. That is to say, six ways ($3\times2=6$) are possible for each combination of the coupler and the layer. From the viewpoint of the resolution power of the human eyes, the light-sensitive layer sensitive to the longest wavelength light is often preferred to be a yellow coloring layer in some cases, or the light-sensitive layer to be exposed with an exposure light source having the worst stability is often preferred to be a yellow coloring layer in some other cases. The order of coating the at least three light-sensitive layers each having a different spectral sensitivity peak on the support is also not specifically defined. From the viewpoint of rapid processability, it is often preferred in some cases that a light-sensitive layer containing silver halide grains having the largest mean grain size and having the longest wavelength spectral sensitivity be the uppermost layer. In addition, from the viewpoint of the sharpness of the image to be formed, the light-sensitive layer having the longest wavelength spectral sensitivity is often preferred to be the uppermost layer in some other cases. Further, from the viewpoint of the storage stability of the hard copies under irradiation of light thereto, the lowermost layer is often preferred to be a magenta coloring layer in some other cases. Therefore, the number of the possible ways of combination of the three kinds of different spectral sensitivities, the three kinds of color couplers and the position of the layers on the support is 36. The present invention may be effectively applicable to any and every photographic material of these 36 configurations. Table 1 below shows specific examples of light sources for digital exposure of photographic materials along with the spectral sensitivity peaks of the materials corresponding thereto and color couplers in the materials, which, however, are not limitative.

TABLE 1

| | Light Source for Digital Scanning Exposure | | | Spectral Sensitivity |
|---|---|---|---|---|
| | Light Source | Wave-length (nm) | Color-ing[2)] | Peak of Photographic Material (nm) |
| 1 | AlGaInAs (670) | 680 | C | 670 |
| | GaAlAs (750) | 750 | Y | 730 |
| | GaAlAs (810) | 810 | M | 810 |
| 2 | AlGaInAs (670) | 670 | Y | 680 |
| | GaAlAs (750) | 750 | M | 760 |
| | GaAlAs (830) | 830 | C | 840 |
| 3 | AlGaInAs (670) | 670 | M | 670 |
| | GaAlAs (750) | 750 | C | 750 |
| | GaAlAs (810) | 810 | Y | 820 |
| 4 | AlGaInAs (670) | 680 | M | 670 |
| | GaAlAs (780) | 780 | C | 780 |
| | GaAlAs (830) | 830 | Y | 840 |
| 5 | AlGaInAs (633) | 633 | Y | 630 |
| | AlGaInAs (680) | 680 | M | 690 |
| | GaAlAs (780) | 780 | C | 780 |
| 6 | GaAlAs (780) | 780 | M | 780 |
| | GaAlAs (830) | 830 | Y | 830 |
| | GaAlAs (880) | 880 | C | 880 |
| 7 | YAG + SHG (KNb03) | 473 | Y | 470 |
| | YV04 + SHG (KTP) | 532 | M | 550 |
| | AlGaInAs (680) | 680 | C | 700 |
| 8 | GaAs (900) + SHG[1)] | 450 | M | 450 |
| | InGaAs (1200) + SHG[1)] | 600 | C | 580 |
| | AlGaInAs (680) | 680 | Y | 700 |

[1)]SHG: Secondary harmonics with non-linear optical element were used.
[2)]The order of the coloring layers from the support is not defined.

The time of exposure of the photographic material of the present invention will be explained in detail below. The photographic material of the present invention is exposed by scanning digital exposure to form an image, in which high-density monochromatic rays from, for example, a gas laser, a semiconductor laser, a solid laser using a semiconductor laser as an exciting light source, a second harmonic generation light source comprising a combination of a semiconductor laser and non-linear optical crystals (non-linear optical elements capable of generating secondary harmonics are described in detail in Optronics (1990), No. 12, p. 55 and ff. and all of them may be employed in the present invention) or the like are irradiated to the photographic material while moving the rays relative to the material to form an image. Therefore, the time of exposure of the silver halides in the photographic material means the time needed for exposing a certain small area of the material to the rays. As the small area, the minimum unit of controlling the quantity of light from the respective digital data is generally employed, which is called a pixel. Therefore, depending upon the size of the pixel, the exposure time to each pixel varies. The size of the pixel depends upon the image density, which has a practical range of from 50 to 2,000 dpi. Where the exposure time is defined to be the time for exposing the pixel size having a pixel density of 400 dpi, the exposure time exposing the photographic material of the present invention is $1\times10^{-7}$ second or less, preferably $5\times10^{-8}$ second or less. Therefore, it is necessary that the leading time or the trailing time of the optical modulator to be applied to the photographic material of the present invention be at least a half or less of the period of the time. If the leading time or the trailing time of the modulator needs a half or more of the exposure time per pixel, the quantity of light from it would vary before the complete quantity of light for exposure so that accurate control of the quantity of light could not be attained. Where the photographic material is subjected to scanning exposure for a longer period of exposure time than $1\times10^{-7}$ second per pixel, the object of the present invention of rapidly obtaining hard copies could not be attained.

The photographic material of the present invention may contain, in addition to the dyes indispensable for constituting the present invention, dyes being capable of decoloring by photographic processing, such as those described in European Patent 0337490A2, pages 27 to 76 (for example, oxonole dyes, cyanine dyes), in the hydrophilic colloid layers of the material for the purpose of improving the safety to a safelight or the like.

In addition, for the purpose of improving the sharpness of the image to be formed, it is preferred to incorporate 12% by weight or more, preferably 14% by weight or more, of titanium oxide as surface-treated with di- to tetra-hydric alcohols (e.g., trimethylolethane) into the water-proofing resin of the support.

It is also preferred that the photographic material of the present invention further contain a color image storability improving compound, such as that described in European Patent 0277589A2, along with the couplers. Especially preferred is a combination of such a compound and pyrazoloazole couplers.

Specifically, incorporation of a compound (F) which may be chemically bonded to the aromatic amine developing agent as remaining after color development to form a chemically inert and substantially colorless compound and/or a compound (G) which may be chemically bonded to an oxidation product of the aromatic amine developing agent as remaining after color development to form a chemically inert and substantially colorless compound into the photographic material of the present invention is preferred, for example, for the purpose of preventing formation of stains and of preventing any other unfavorable side effects to be caused by reaction of the remaining color developing agent or an oxidation product thereof and couplers in the photographic material during storage of the processed material.

In addition, the photographic material of the present invention also preferably contains various microbicides such as those described in JP-A-63-271247, for the purpose of exterminating various fungi and bacteria which would propagate in the hydrophilic colloid layers and deteriorate the images formed.

As the support to be in the photographic material of the present invention, a white polyester support or a support as coated with a white pigment-containing layer on the surface to receive silver halide emulsion layers thereon may be used for display of the images formed on the material. In addition, for the purpose of improving the sharpness of the images to be formed, an anti-halation layer is desired to be formed on either surface of the support. In particular, it is preferred that the transmittance density of the support be defined to fall within the range of from 0.35 to 0.8 in order that the displayed images may be seen by either a reflected light or a transmitted light.

A transparent support may also preferably be employed as the support of the photographic material of the present invention. In such a case, provision of an anti-halation layer on the side of the support as coated with the silver halide emulsion layers or on the back surface of the support is preferred.

The exposed photographic material is processed by conventional black-and-white development or color development. Where the material of the present invention is a color photographic material, it is desired to be first subjected to color development and then to bleach-fixation for the purpose of effecting rapid processing. In particular, where the material contains the above-mentioned high silver chloride emulsion, the pH value of the bleach-fixing solution to be used for processing it is desired to be about 6.5 or less, especially preferably about 6 or less, for promoting the desilvering speed.

For silver halide emulsions and other elements (additives, etc.) constituting the photographic materials of the present invention as well as constitution of photographic layers (arrangement of layers, etc.) of the materials, and processing methods and processing additives to be used for processing the materials, for example, disclosures of the following references, especially the following European Patent EP 0.355,660A2 (corresponding to Japanese Patent Application No. 1-107011), may be referred to.

| Photographic Elements | JP-A-62-215272 | JP-A-2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from the bottom to page 18, left lower column, last line | — | — |

-continued

| Photographic Elements | JP-A-62-215272 | JP-A-2-33144 | EP 0,355,660A2 |
|---|---|---|---|
| Chemical Sensitizers | Page 12, from left lower column, line 3 from the bottom to right lower column, line 5 from the bottom; and from page 18, right lower column, line 1 to page 22, right upper column, line 9 from the bottom | Page 29, right lower column, line 12 to last line | Page 47, lines 4 to 9 |
| Spectral Sensitizers (Spectral Sensitizing Methods) | From page 22, right upper column, line 8 from the bottom to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 8, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from the bottom | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, | Page 36, right lower column, lines 8 to 11 | From page 64, line 57 to page 65, line 1 |

-continued

| Photographic Elements | JP-A-62-215272 | JP-A-2-33144 | EP 0,355,660A2 |
|---|---|---|---|
| | right lower column, line 3 | | |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last line | From page 18, right upper column, line 1 to page 24, right lower column, last line; and page 27, from left lower column, line 10 from the bottom to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Thickener | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Matting Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

Notes: The cited specification of JP-A-62-215272 is one as amended by the letter of amendment filed on March 16, 1987.

As cyan couplers, 3-hydroxypyridine cyan couplers as described in European Patent 0,333,185A2 (especially, 2-equivalent couplers formed by adding a chlorinated leaving group to the illustrated 4-equivalent Coupler (42), as well as the illustrated Couplers (6) and (9)), and cyclic active methylene cyan couplers as described in JP-A-64-32260 (especially, Couplers Nos. 3, 8 and 34 specifically illustrated therein) are also preferably employed, in addition to the diphenylimidazole cyan couplers described in the above-mentioned JP-A-2-33144.

As the method of processing the color photographic material of the present invention, the method as described in JP-A-2-207250 is preferred.

The processing temperature in processing the photographic material of the present invention with a color developer is from 20° to 50° C., preferably from 30° to 45° C. The processing time is preferably substantially within 20 seconds. The amount of the replenisher to the color developer is desired to be as small as possible. Suitably, it may be from 20 to 600 ml, preferably from 50 to 300 ml, more preferably from 60 to 200 ml, most preferably from 60 to 150 ml, per $m^2$ of the photographic material being processed.

In processing the photographic material of the present invention, the developing time is desired to be substantially within 25 seconds. The time of "substantially within 25 seconds" as referred to herein indicates the time from introduction of the photographic material to be developed into the developer tank to transfer of the material to the next tank, including the blank transition time from the developer tank to the next tank.

The rinsing step or stabilization step for processing the developed photographic material of the present invention is desired to have a pH condition of from 4 to 10, more preferably from 5 to 8. The temperature for the step may be determined variously in accordance with the use and characteristics of the photographic material being processed. In general, it may be from 30° to 45° C., preferably from 35° to 42° C. The processing time for the step may also be determined freely, but it is desired to be as small as possible from the viewpoint of shortening the processing time. Preferably, it may be from 10 to 45 seconds, more preferably from 10 to 40 seconds. The amount of the replenisher to the rinsing or stabilization step is desired to be as small as possible from the viewpoint of reducing the running cost, reducing the amount of the waste to be drained and improving the ease of handling of the material being processed.

Specifically, the amount of the replenisher may be from 0.5 to 50 times, preferably from 2 to 15 times, of the carryover from the previous bath, per unit area of the photographic material being processed; or it may be 300 ml or less, preferably 150 ml or less, per $m^2$ of the photographic material being processed. Replenishment may be effected either continuously or intermittently.

The liquid as used in the rinsing and/or stabilizing step may be used again in the previous step. As one preferred example of such a system, there is a multi-stage counter-current system, in which the overflow of the rinsing water from the rinsing step may be recirculated into the previous bleach-fixing bath and a concentrated bleach-fixing liquid is replenished to the bleach-fixing bath so that the amount of the waste to be drained from the process may be reduced.

Next, a drying step employable in processing the photographic material of the present invention will be mentioned below.

In order to complete photographic images by ultrarapid processing of the present invention, the drying time is desired to be from 20 seconds to 40 seconds. As a means of shortening the drying time, for example, the amount of the hydrophilic binder such as gelatin in the photographic material may be reduced whereby the amount of water to be introduced into the photographic material being processed may be reduced. In addition, for the purpose of reducing the amount of water to be introduced into the photographic material being processed, the material may be squeezed with squeezing rollers or rubbed with cloth immediately after being taken out from the rinsing bath so as to remove water from the material, whereby drying of the rinsed material may be promoted. Naturally, the drier may also be improved so as to shorten the drying time, for example, by elevating the drying temperature or by enhancing the drying air. In addition, the angle of the drying air to be applied to the material being processed may suitably be adjusted or removal of the exhaust air from the drying chamber may be adjusted, whereby drying of the material being processed may be promoted further.

The optical modulator to be employed in the present invention will be explained below. As the optical modulator, any of a bulk acousto-optical modulator, a waveguide acousto-optical modulator, a waveguide electro-optical modulator and the like may be employed.

The modulation principle of an acousto-optical modulator is shown in FIG. 1. As is shown in FIG. 1, where RF signals of about several hundred MHz are inputted into an ultrasonic transducer, ultrasonic waves (surface acoustic wave: SEW) are generated. Ultrasonic waves cause variation of the refractive index due to the strain thereof and form diffraction lattices of the refractive index having the same cycle as the ultrasonic wave cycle. Where incident beams are applied to the diffraction lattices at an angle of Bragg diffraction, they cause diffraction so that the light path of the beams is thereby varied. In optical modulation, the intensity of the diffracted light may freely be varied by ON/Off change of the inputting RF power or by variation of the inputting RF power. A bulk acousto-optical modulator is described in detail in *Bases of Opto-electronics* (written by Amnon Yariv, translated by K. Tada & T. Kamiya, published by Maruzen Publishing Co.). A waveguide acousto-optical modulator is described in detail in JP-A-3-127026 and in Nishihara, Haruna & Suhara, *Optical Integrated Circuits* (published by Ohm Co., 1985). A waveguide electro-optical modulator is described in JP-A-2-931 and in the above-mentioned *Optical Integrated Circuits.*

Of the various modulators, a waveguide acousto-optical modulator and a waveguide electro-optical modulator are especially preferably employed in the present invention in view of the rising speed of them.

A preferred embodiment of the present invention will be explained below, with reference to the drawings attached hereto. However, the present invention is not limited only to the illustrated embodiment.

Figure 2:
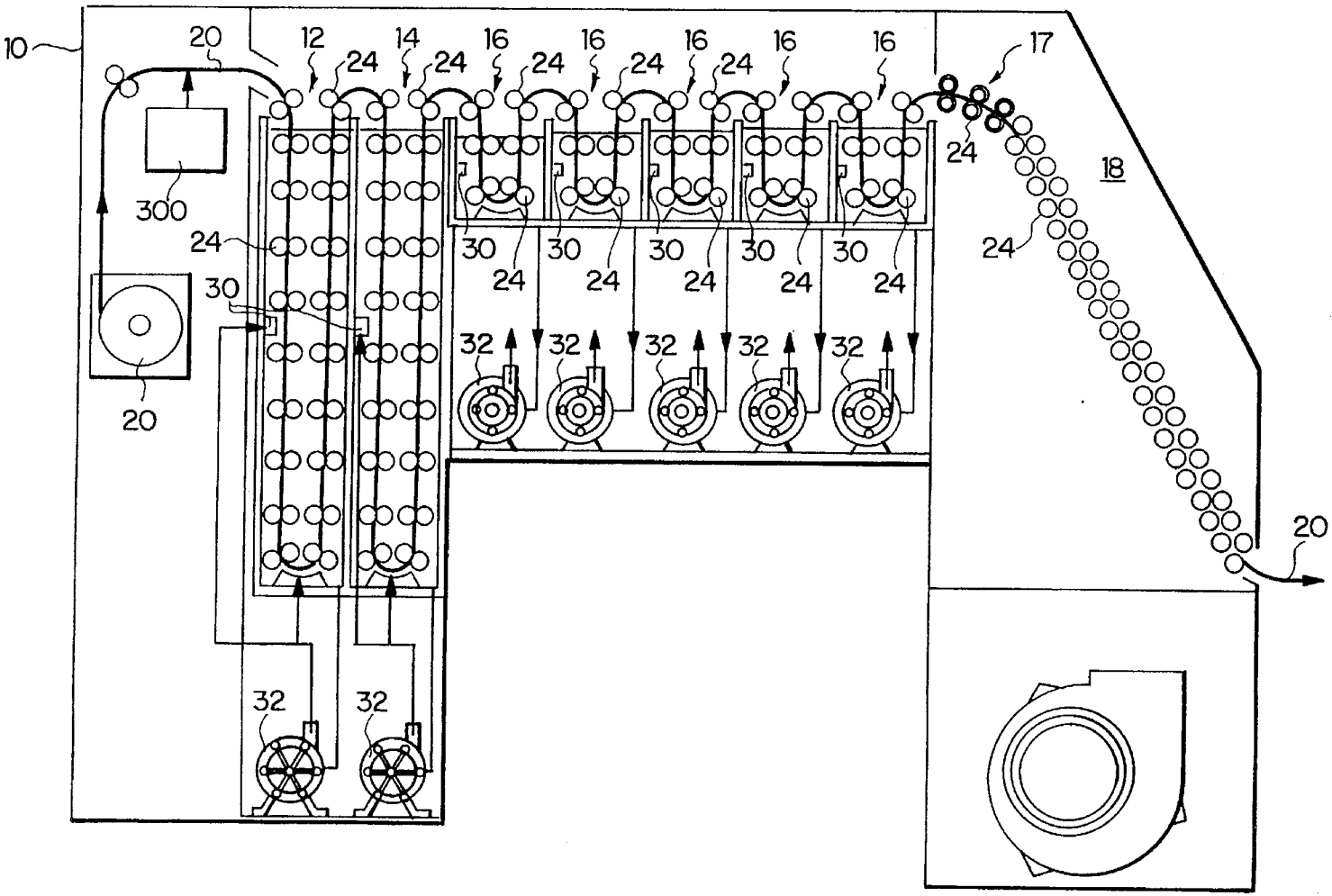
FIG. 2 is an outline constitutive view showing an image forming device to be employed for carrying out the present invention.

FIG. 2 is an outline constitutive view showing an image forming device for a silver salt photographic color paper to be employed for carrying out one embodiment of the present invention. Using the image forming device, a color paper is exposed, developed, bleach-fixed, rinsed and dried to form an image on the paper. The color paper (or photographic material) to be processed by the image forming device is a color photographic material having at least one silver halide emulsion layer containing 95 mol % or more silver chloride on a support, and it is color-developed with a color developer containing an aromatic primary amine color-developing agent. The image forming device body 10 is composed of an exposure device 300, a development tank 12, a bleach-fixation tank 14, a rinsing tank 16, a squeezing zone 17 and a drying zone 18 as connected in series. After being exposed, the photographic material 20 is developed, bleach-fixed, rinsed and then dried, and it is taken out from the body 10. The developer tank 12, the bleach-fixation tank 14, the rinsing tank 16, the squeezing zone 17 and the drying zone 18 each is provided with a pair of conveying rollers 24 for holding the photographic material 20 therebetween to carry it through the respective processing zones. The pair of conveying rollers 24 in the squeezing zone 17 also act as water-squeezing rollers for removing the water drops from the photographic material 20 by squeezing or absorption. The photographic material 20 is dipped in the respective processing solutions for a determined period of time while being held between the pair of conveying rollers 24 and conveyed by them through the respective processing solutions with the emulsion-coated surface of it facing downwardly, whereby the material is color-developed. The development tank 12, the bleach-fixation tank 14 and the rinsing tank 16 each are provided with a processing solution-jetting part 30 for strongly jetting the processing solution out to the respective processing tanks to form a high-speed jet stream of the solution in the tanks, at determined positions of the tanks. Pumps 32 are provided for the development tank 12, the bleach-fixation tank 14 and the rinsing tank 16, and the respective processing solutions are jetted out to the photographic material 20 being processed through the processing solution jetting parts 30 while being circulated by the pumps 32.

Figure 3:
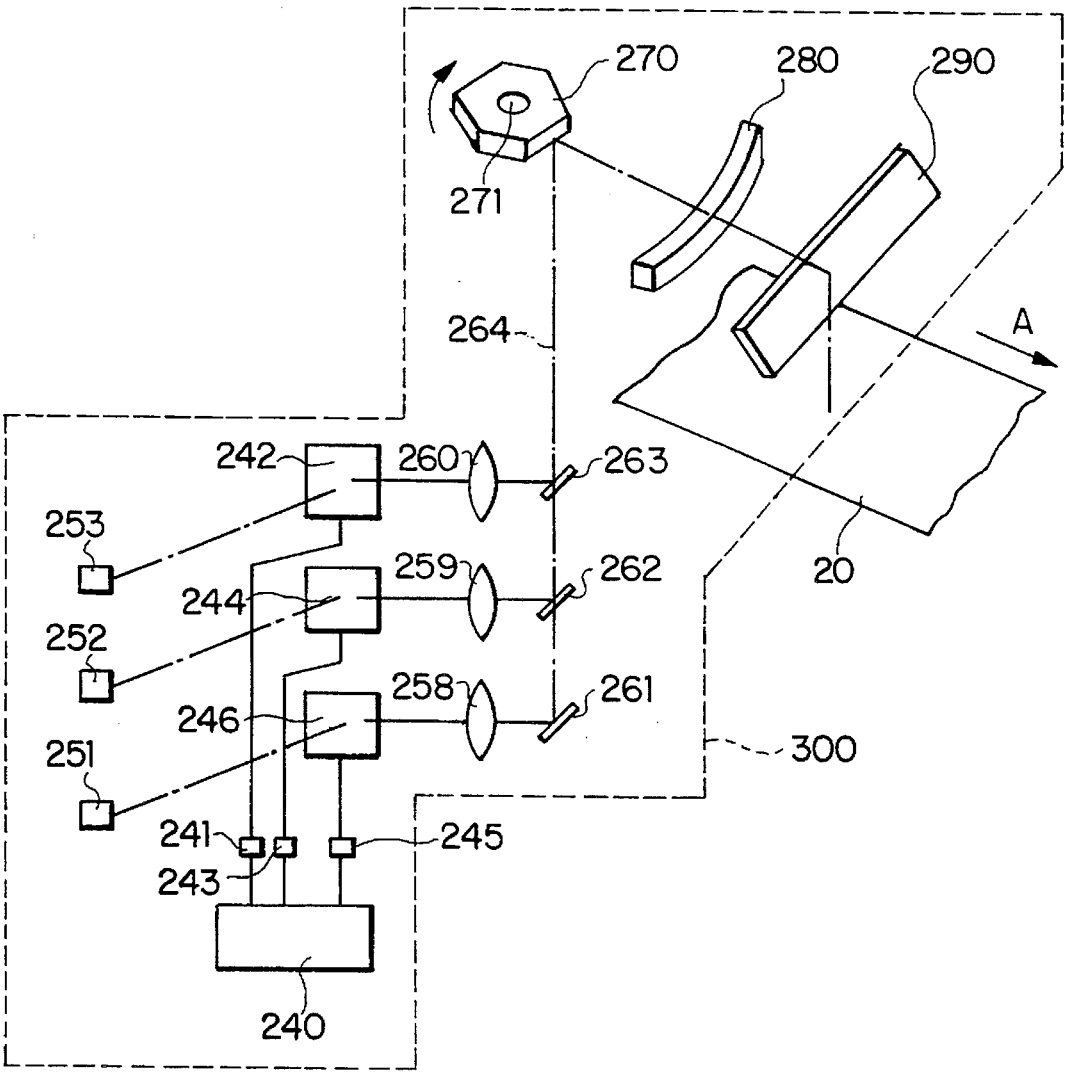
FIG. 3 is an outline constitutive view showing an exposure device to be employed for carrying out the present invention.

FIG. 3 is a constitutive view showing an exposure device 300 which may be employed for carrying out one embodiment of the present invention.

The exposure device 300 emits one combination of three lights therefrom to expose the photographic material 20 with the lights. The exposure device 300 transmits modulated signals, as a varying voltage intensity, through the optical modulator driving circuits 241, 243 and 245 on the basis of the image data as processed in the image processing device 240 connected with a computer or the like, whereby the waveguide acousto-optical modulators 242, 244 and 246 are driven. Accordingly, the quantity of light of the lasers 251, 252 and 253 is varied and the photographic material 20 is thereby exposed. In the exposure device 300, the light for cyan coloring is formed by the semiconductor laser 251 which is capable of radiating a laser ray having a wavelength of 670 nm. As the semiconductor laser 251, for example, Toshiba's TOLD 9200 Model, NEC's NDL 3200 Model and Sony's SLD151U Model may be used. The laser ray having a wavelength of 670 nm as radiated from the semiconductor laser 251 is modulated in the optical modulator 246, then ordered through the collimator lens 258 and is reflected by the total reflection mirror 261 towards the polygon mirror 270. For magenta coloring, the laser 252 is used in which $YVO_4$ solid laser crystals are excited by the exciting light source of a GaAlAs semiconductor laser (having an oscillating wavelength of 808.5 nm) to give a ray having an oscillation wavelength of 1064 nm, the wavelength of the ray is converted or reduced by $KTiOPO_4$ (KTP) of Second Harmonic Generation (SHG) crystals to 532 nm (half of 1064 nm) and the ray of 532 nm is radiated from the laser 252. The laser ray having a wavelength of 532 nm as radiated from the laser 252 is modulated in the optical modulator 244, then ordered through the collimator lens 259 and the light for magenta coloring is reflected by the dichroic mirror 262 towards the polygon mirror 270 with the light for cyan coloring penetrating therethrough. For yellow coloring, the laser 253 is used in which YAG solid laser crystals are excited by the exciting light source of a GaAlAs semiconductor laser (having an oscillating wavelength of 808.5 nm) to give a ray having an oscillation wavelength of 946 nm, the wavelength of the ray is converted or reduced by $KNbO_3$ of Second Harmonic Generation (SHG) crystals to 473 nm (half of 946 nm) and the ray of 473 nm is radiated from the laser 253.

The laser ray having a wavelength of 473 nm as radiated from the laser 253 is modulated in the optical modulator 242, then ordered through the collimator lens 260 and the light for yellow coloring is reflected by the dichroic mirror 263 towards the polygon mirror 270 with the light for magenta coloring and the light for cyan coloring penetrating therethrough. The above-mentioned lights for separate cyan, magenta and yellow coloring are reflected by the polygon mirror 270 via the light path 264, and are further reflected by the mirror 290 through the fθ lens 280 to reach the photographic material 20. By rotating the polygon mirror 270 around the center of the axis 271, the photographic material 20 is exposed to the irradiated lights by scanning exposure. By moving the photographic material 20 in the direction (shown by the arrow A) perpendicular to the scanning direction of the laser rays, the material 20 is sub-scanned to form an image thereon. The fluctuation of the light paths of the three luminous fluxes is previously compensated by the control circuit of the modulator. The moving speed of the photographic material 20 during exposure of the material is same as the moving speed of the material during development of the material, and the development of the exposed area of the photographic material 20 is initiated after the lapse of the same time as the exposure time.

The above-mentioned exposure device 300 has such a constitution that the photographic material 20 is exposed on the basis of the image information as processed by a computer or the like. Apart from the illustrated type, the photographic material 20 may also be exposed on the basis of image information obtained by reading an original.

The detailed constitution and control of the wave-guide acousto-optical modulators 242, 244 and 246 are described in JP-A-3-127026, FIG. 1 and FIG. 2.

The present invention will be explained in more detail by way of the following examples, which, however, are not limitative.

EXAMPLE 1

Preparation of Photographic Material Sample No. 101:

One surface of a paper support as laminated with polyethylene on the both surfaces thereof was corona-discharged, and a gelatin subbing layer containing sodium dodecylbenzenesulfonate was provided thereon. In addition, plural photographic layers were coated thereover to form a multi-layer color photographic paper sample (No. 101) having the layer constitution mentioned below. Coating compositions were prepared in the manner mentioned below.

Preparation of Coating Composition for First Layer:

153.0 g of yellow coupler (ExY), 15.0 g of color image stabilizer (Cpd-1), 7.5 g of color image stabilizer (Cpd-2) and 16.0 g of color image stabilizer (Cpd-3) were dissolved in 25 g of solvent (Solv-1), 25 g of solvent (Solv-2) and 180 cc of ethyl acetate, and the resulting solution was dispersed by emulsification in 60 cc of 10% sodium dodecylbenzenesulfonate and 1000 cc of an aqueous 10% gelatin solution containing 10 g of citric acid, to prepare Emulsified Dispersion A. On the other hand, Silver Chlorobromide Emulsion A was prepared, being a 3/7 mixture (by mol of Ag) of an emulsion of large-size cubic grains having a mean grain size of 0.88 μm and an emulsion of small-size cubic grains having a mean grain size of 0.70 μm, the coefficient of variation of the grain size distribution of the large-size emulsion being 0.08 and that of the small-size emulsion being 0.10. Both the large-size and small-size emulsions comprised silver chloride grains each having 0.3 mol % of localized silver bromide phase partially on the surface of the grain; and 0.4 mg of potassium hexachloroiridate (IV) and 1.8 mg of potassium ferrocyanide were incorporated in each of the large-size emulsion and the small-size emulsion, respectively, and distributed throughout the insides of the grains and the localized silver bromide phase regions of the grains. The emulsion mixture contained the following Blue-sensitizing Dyes A and B in an amount of $2.0\times10^{-4}$ mol and $2.5\times10^{-4}$ mol, respectively, in both the large-size emulsion and the small-size emulsion; and after the addition of the sensitizing dyes, the emulsion mixture was subjected to optimum chemical sensitization by adding a sulfur sensitizing agent and a gold sensitizing agent thereto in the presence of a decomposate of nucleic acid. The above-mentioned Emulsified Dispersion A and the Silver Chlorobromide Emulsion A were blended to prepare a coating liquid for the first layer having the composition mentioned below.

Other coating liquids for the second layer to seventh layer were prepared in the same manner as above. As a gelatin hardening agent for each layer, 1-hydroxy-3,5-dichloro-s-triazine sodium salt was used.

The layers contained Cpd-14 and Cpd-15 shown hereinafter in a total amount of 25.0 mg/m$^2$ and 50.0 mg/m$^2$, respectively.

The silver chlorobromide emulsions for the respective light-sensitive emulsion layers were prepared in the same manner as in preparation of the above-mentioned Silver Chlorobromide Emulsion A with respect to adjustment of the size of the constitutive silver halide grains, and they contained the following spectrally sensitizing dyes.

Blue-sensitive Emulsion Layer:

This layer contained the following Sensitizing Dyes A and B, each in an amount of $2.0\times10^{-4}$ mol per mol of silver halide in the large-size emulsion and $2.5\times10^{-4}$ mol per mol of silver halide in the small-size emulsion.

Sensitizing Dye A:

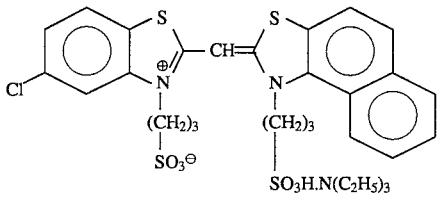

Sensitizing Dye B:

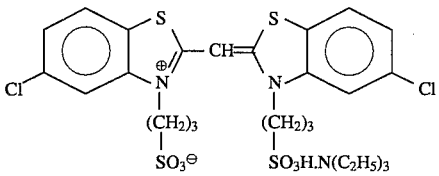

Green-sensitive Emulsion Layer:

This layer contained the following Sensitizing Dye C in an amount of $4.0\times10^{-4}$ mol per mol of silver halide in the large-size emulsion and $5.6\times10^{-4}$ mol per mol of silver halide in the small-size emulsion and the following Sensitizing Dye D in an amount of $7.0\times10^{-5}$ mol per mol of silver halide in the large-size emulsion and $1.0\times10^{-5}$ mol per mol of silver halide in the small-size emulsion.

Sensitizing Dye C:

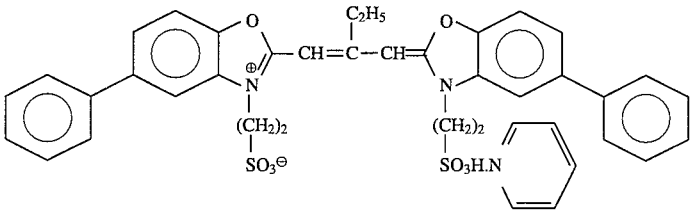

Sensitizing Dye D:

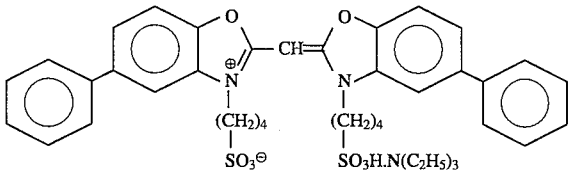

Red-sensitive Emulsion Layer:

This contained the following Sensitizing Dye E in an amount of $0.9\times10^{-4}$ mol per mol of silver halide in the large-size emulsion and $1.1\times10^{-4}$ mol per mol of silver halide in the small-size emulsion.

Sensitizing Dye E:

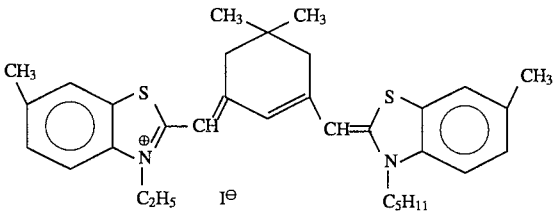

This layer further contained the following compound in an amount of $2.6\times10^{-3}$ mol per mol of silver halide.

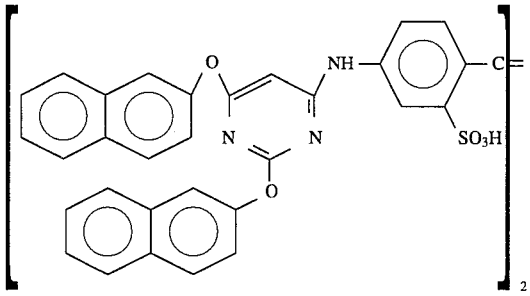

To the blue-sensitive emulsion layer, the green-sensitive emulsion layer and the red-sensitive emulsion layer, 1-(5-methylureidophenyl)-5-mercaptotetrazole was added in an amount of $8.5\times10^{-4}$ mol, $3.0\times10^{-3}$ mol and $2.5\times10^{-4}$ mol, respectively, per mol of silver halide.

To the blue-sensitive emulsion layer and the green-sensitive emulsion layer, 4-hydroxy-6-methyl-1,3,3a,7-tetrazaindene was added in an amount of $1\times10^{-4}$ mol and $2\times10^{-4}$ mol, respectively, per mol of silver halide.

Layer Constitution:

The composition of each layer is given below. The amount coated is represented by a unit of g/m$^2$. The amount of the silver halide emulsion coated is represented as the amount of silver therein.

Support:

Polyethylene-laminated paper, containing a white pigment ($TiO_2$; content of 15 wt. %) and a bluish dye (ultramarine) in the polyethylene on the side of the first layer.

| | |
|---|---|
| First Layer (blue-sensitive emulsion layer): | |
| Above-mentioned Silver Chlorobromide Emulsion A | 0.27 |
| Gelatin | 1.22 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer (color mixing preventing layer): | |
| Gelatin | 0.90 |
| Color Mixing Preventing Agent (Cpd-4) | 0.06 |
| Solvent (Solv-7) | 0.03 |
| Solvent (Solv-2) | 0.25 |
| Solvent (Solv-3) | 0.25 |

-continued

| | |
|---|---|
| Third Layer (green-sensitive emulsion layer): | |
| Silver Chlorobromide Emulsion B (this is a ⅓ mixture (by mol of silver) of an emulsion of large-size cubic grains having a mean grain size of 0.55 μm and an emulsion of small-size cubic grains having a mean grain size of 0.39 μm; the coefficient of variation of the grain size distribution of the large-size emulsion is 0.10 and that of the small-size emulsion is 0.08; both the large-size and small size emulsions comprise silver chloride grains each having 0.8 mol % of localized silver bromide phase partially on the surface of the grain; and 0.5 mg of potassium hexachloroiridate (IV) and 2 mg of potassium ferrocyanide were incorporated in each of the large-size emulsion and the small-size emulsion, respectively, and distributed throughout the insides of the grains and the localized silver bromide phase regions of the grains.) | 0.13 |
| Gelatin | 1.28 |
| Magenta Coupler (ExM) | 0.16 |
| Color Image Stabilizer (Cpd-5) | 0.15 |
| Color Image Stabilizer (Cpd-2) | 0.03 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing preventing layer): | |
| Gelatin | 0.70 |
| Color Mixing Preventing Agent (Cpd-4) | 0.04 |
| Solvent (Solv-7) | 0.02 |
| Solvent (Solv-2) | 0.18 |
| Solvent (Solv-3) | 0.18 |
| Fifth Layer (red-sensitive emulsion layer): | |
| Silver Chlorobromide Emulsion C (this is a ¼ mixture (by mol of silver) of an emulsion of large-size cubic grains having a mean grain size of 0.50 μm and an emulsion of small-size cubic grains having a mean grain size of 0.41 μm; the coefficient of variation of the grain size distribution of the large-size emulsion is 0.09 and that of the small-size emulsion is 0.11; both the large-size and small size emulsions comprise silver chloride grains each having 0.8 mol % of localized silver bromide phase partially on the surface of the grain; and 0.5 mg of potassium hexachloroiridate (IV) and 2.5 mg of potassium ferrocyanide were incorporated in each of the large-size emulsion and the small-size emulsion, respectively, and distributed throughout the insides of the grains and the localized silver bromide phase regions of the grains.) | 0.18 |
| Gelatin | 0.80 |
| Cyan Coupler (ExC) | 0.33 |
| Color Image Stabilizer (Cpd-1) | 0.35 |
| Color Image Stabilizer (Cpd-2) | 0.03 |
| Color Image Stabilizer (Cpd-5) | 0.15 |
| Color Image Stabilizer (Cpd-6) | 0.01 |
| Color Image Stabilizer (Cpd-7) | 0.01 |
| Color Image Stabilizer (Cpd-8) | 0.08 |
| Color Image Stabilizer (Cpd-9) | 0.01 |
| Color Image Stabilizer (Cpd-10) | 0.01 |
| Color Image Stabilizer (Cpd-11) | 0.01 |
| Solvent (Solv-1) | 0.01 |
| Solvent (Solv-6) | 0.22 |
| Sixth Layer (ultraviolet absorbing layer): | |
| Gelatin | 0.48 |
| Ultraviolet Absorbent (UV-1) | 0.38 |
| Color Image Stabilizer (Cpd-5) | 0.02 |
| Color Image Stabilizer (Cpd-12) | 0.15 |
| Seventh Layer (protective layer): | |
| Gelatin | 1.10 |
| Acryl-modified Copolymer of Polyvinyl Alcohol (modification degree 17%) | 0.05 |
| Liquid Paraffin | 0.02 |
| Color Image Stabilizer (Cpd-13) | 0.01 |

Compounds used above are mentioned below.

ExY: yellow coupler

1/1 mixture (by mol) of the following compounds:

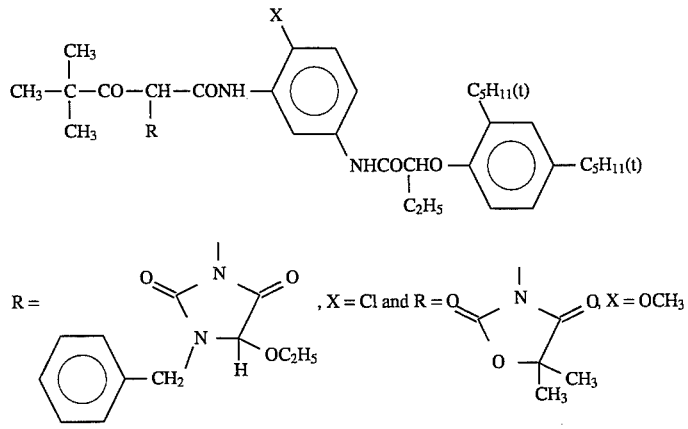

ExM: magenta coupler

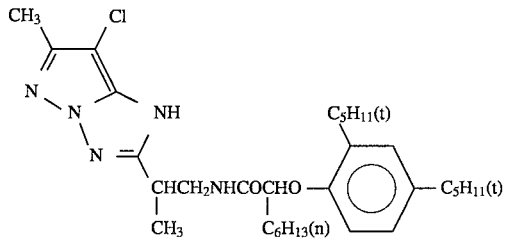

ExC: cyan coupler

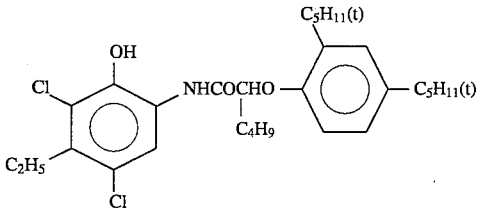

Cpd-1: color image stabilizer

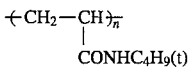

mean molecular weight: 60,000

Cpd-2: color image stabilizer

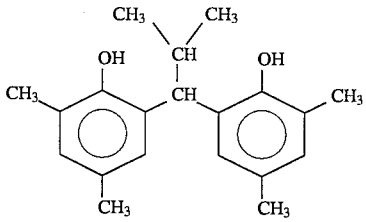

Cpd-3: color image stabilizer

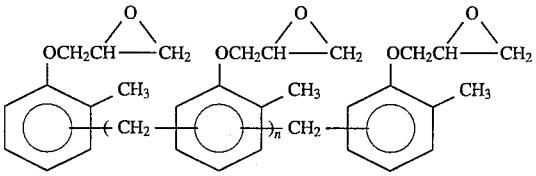

n=7 to 8 (on an average)

Cpd-4: color mixing preventing agent

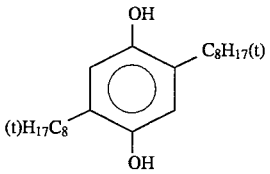

Cpd-5: color image stabilizer

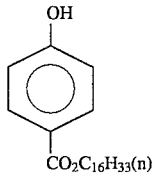

Cpd-6: color image stabilizer

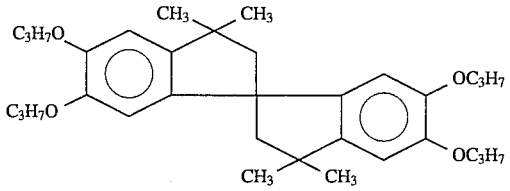

Cpd-7: color image stabilizer

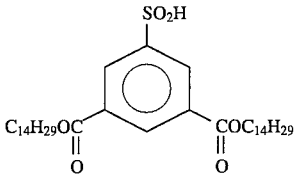

Cpd-8: color image stabilizer

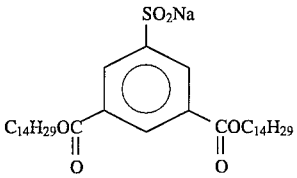

Cpd-9: color image stabilizer

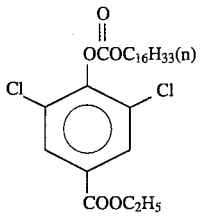

Cpd-10: color image stabilizer

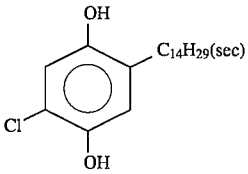

Cpd-11: color image stabilizer

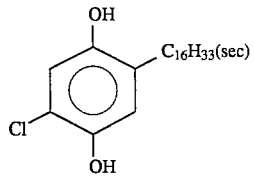

Cpd-12: color image stabilizer

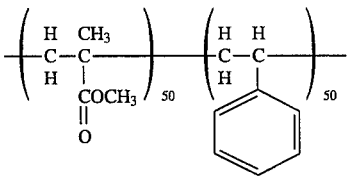

mean molecular weight: 60,000

Cpd-13: color image stabilizer

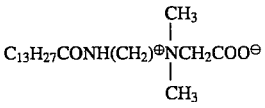

Cpd-14: antiseptic

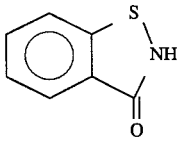

Cpd-15: antiseptic

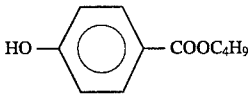

UV-1: ultraviolet absorbent

1/5/10/5 mixture (by weight) of the following (i), (ii), (iii), (iv):

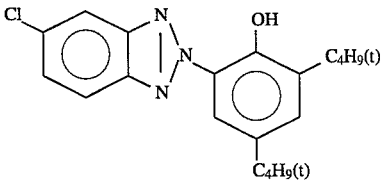

(i)

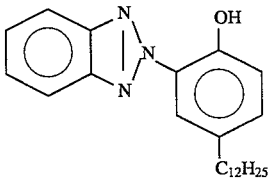

(ii)

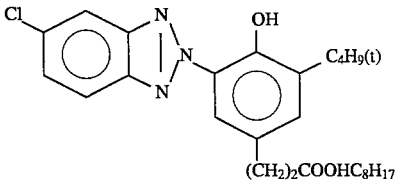

(iii)

-continued

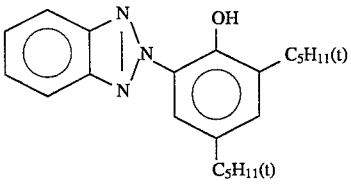

(iv)

UV-2: ultraviolet absorbent

1/2/2 mixture (by weight) of the following (v), (vi), (vii):

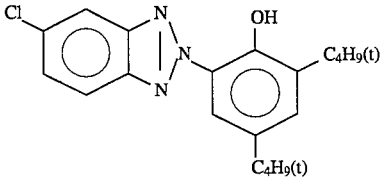

(v)

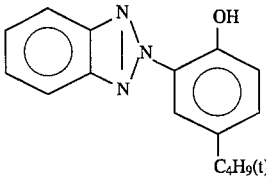

(vi)

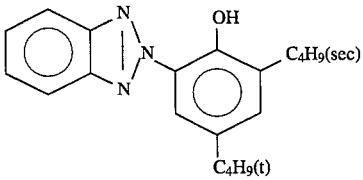

(vii)

Solv-1: solvent

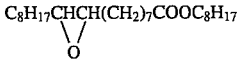

Solv-2: solvent

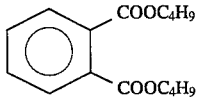

Solv-3: solvent

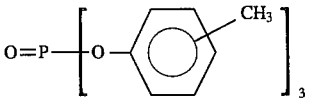

Solv-4: solvent

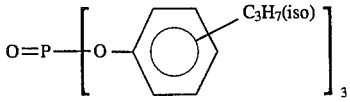

Solv-5: solvent

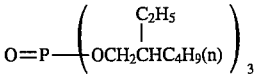

Solv-6: solvent

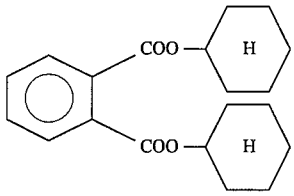

Solv-7: solvent

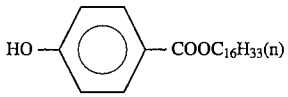

Preparation of Photographic Material Sample Nos. 102 to 107:

Photographic Material Sample Nos. 102 to 107 were prepared in the same manner as Sample No. 101, except that the dyes of the amounts as indicated in Table 2 below were added to the second layer (color mixing preventing layer). The dyes added were uniformly distributed throughout the second layer in each coated sample.

TABLE 2

| Sample No. | Dyes Added and Their Amounts (mg/m$^2$) |
|---|---|
| 101 | |
| 102 | Dye-2 (5.0); Dye-4 (7.0) |
| 103 | Dye-2 (5.0); Dye-4 (15.0) |
| 104 | Dye 2 (15.0); Dye-3 (30.0) |
| 105 | Dye-1 (15.0); Dye-2 (10.0); Dye-3 (30.0) |
| 106 | Dye-1 (35.0); Dye-2 (10.0); Dye-4 (40.0) |
| 107 | Dye-1 (70.0); Dye-2 (15.0); Dye-3 (5.0); Dye-4 (40.0) |

Dyes used above are mentioned below.

Dye-1:

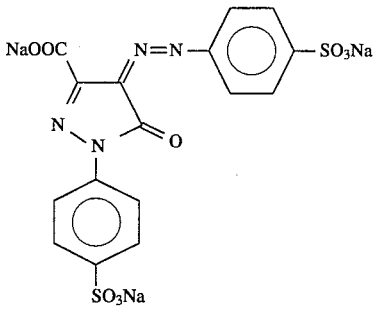

Dye-2:

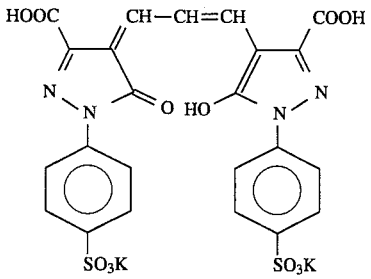

Dye-3:

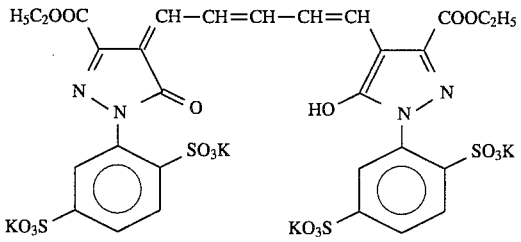

Dye-4:

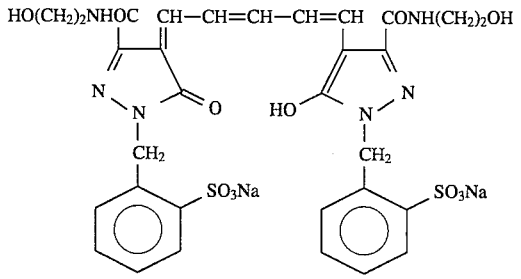

The samples thus prepared were exposed and developed, using the image forming device of FIG. 2 and FIG. 3. The rotation number of the octagonal polygon mirror was (a) 45,000 rpm, (b) 25,000 rpm, (c) 10,000 rpm and (d) 5,000 rpm. Using the mirror having a varying exposure speed mentioned above, the A-4 size samples were exposed to have a pixel density of 400 dpi, whereupon the exposure time per pixel was (a) about $5\times10^{-8}$ second, (b) about $9\times10^{-8}$ second, (c) about $2\times10^{-7}$ second and (d) about $4.5\times10^{-7}$ second, and the time needed for exposing one A-4 size sample was (a) 0.8 second, (b) 1.4 seconds, (c) 3.5 seconds and (d) 7 seconds.

The rising time of the optical modulator used in the device was about $1\times10^{-8}$ second, which was well controlled for the respective exposure times.

Using the exposing device, the quantity of light from each laser as applied to each sample for exposure was stepwise varied for each one cm$^2$ area of the sample. The exposed samples were then developed, and the relation (look-up table) of the color density of the formed image and the controlled signal intensity was obtained.

Apart from the above, a picture of a landscape scene (1) and a picture comprising letters and lines (2) were separately taken using a color reversal film; and image data (1) and image data (2) were prepared separately from each picture by reading it with a color scanner. Through the two image data (1) and (2), each of the previously prepared Photographic Material Sample Nos. 101 to 107 was exposed at each of the previously defined four exposure speeds, and the exposed samples were then developed. The difference in the color tone between the original and the image obtained was checked. The results obtained are shown in Table 3 below along with the reflectivity of the photographic material samples. In Table 3, "○" indicates that there was almost no difference in the color tone between the original and the image obtained; "Δ" indicates that there was small difference in the same; and "X" indicates that there was great difference in the same.

TABLE 3

| Sample | Reflectivity of Sample (at LD wavelength) | | | Difference in Color Tone between Original and Image Formed: Scene (1) (exposure speed) | | | | Scene (2) (exposure speed) | | | | |
|---|---|---|---|---|---|---|---|---|---|---|---|---|
| No. | 473 nm | 532 nm | 670 nm | (a) | (b) | (c) | (d) | (a) | (b) | (c) | (d) | Remarks |
| 101 | 85% | 90% | 85% | Δ | Δ | ○ | ○ | X | X | Δ | ○ | comparative sample |
| 102 | 65 | 45 | 50 | Δ | ○ | ○ | ○ | X | X | ○ | ○ | comparative sample |
| 103 | 65 | 43 | 29 | ○ | ○ | ○ | ○ | Δ | Δ | ○ | ○ | sample of the invention |
| 104 | 63 | 30 | 10 | ○ | ○ | ○ | ○ | Δ | ○ | ○ | ○ | sample of the invention |
| 105 | 30 | 29 | 10 | ○ | ○ | ○ | ○ | ○ | ○ | ○ | ○ | sample of the invention |
| 106 | 25 | 28 | 8 | ○ | ○ | ○ | ○ | ○ | ○ | ○ | ○ | sample of the invention |
| 107 | 13 | 23 | 6 | ○ | ○ | ○ | ○ | ○ | ○ | ○ | ○ | sample of the invention |

The process of development of the samples comprised the following steps.

Development Process:

| Step | Temperature | Time | Amount of Replenisher(*) | Capacity of Tank |
|---|---|---|---|---|
| Color Development | 35° C. | 45 sec | 161 ml | 17 liters |
| Bleach-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

(*)The amount of replenisher was per $m^2$ of the sample being processed. Rinsing was effected by 3-tank countercurrent system from rinsing (3) to rinsing (1).

Processing solutions used above are described below.

Color Developer.:

| | Tank Solution | Replenisher |
|---|---|---|
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-ethyl-N-(β-methanesulfonamidoethyl)-3-methyl-4-aminoaniline Sulfate | 5.0 g | 7.0 g |
| N,N-bis(carboxymethyl)-hydrazine | 4.0 g | 5.0 g |
| N,N-di(sulfoethyl)hydroxylamine Monosodium Salt | 4.0 g | 5.0 g |
| Brightening Agent (WHITEX 4B, product of Sumitomo Chemical Co.) | 1.0 g | 2.0 g |
| Water to make | 1000 ml | 1000 ml |
| pH (at 25° C.) | 10.05 | 10.45 |

Bleach-fixing Solution:

The tank solution and the replenisher were the same.

| | |
|---|---|
| Water | 400 ml |
| Ammonium Thiosulfate (700 g/liter) | 100 ml |
| Sodium Sulfite | 17 g |
| Ammonium Ethylenediaminetetra-acetato/Iron(III) | 55 g |
| Disodium Ethylenediaminetetraacetate | 5 g |
| Ammonium Bromide | 40 g |
| Water to make | 1000 ml |
| pH (at 25° C.) | 6.0 |

Rinsing Solution:

The tank solution and the replenisher were the same.

Ion-exchanged water having calcium and magnesium content of each 3 ppm or less was used.

From the results obtained, it is noted that the A-4 size photographic material samples of the present invention were well exposed within one second or so by high-speed scanning exposure requiring an exposure time of less than $1\times10^{-7}$ second per pixel. However, it is also noted that if a photographic material having a reflectivity of more than 30% is applied to such high-speed scanning exposure, the image formed often involves a problem that the color tone of the image is different from that of the original, depending upon the scene of the original. In particular, the problem is noticeable from the image of an original of a scene comprising letters and lines. On the contrary, in long-time scanning exposures requiring more than $1\times10^{-7}$ second, the difference in the color tone between the original and the image from it has almost no relation to the reflectivity of the photographic material and all the tested samples had the reproducibility of almost faithfully reproducing an image from the original. In such long-time scanning exposures, however, from several seconds to nearly 10 seconds are required for exposing one A-4 size photographic material sample, and the long-time scanning exposures are lacking in terms of rapid processability.

From the results, it is understood that rapid exposures with no difference in the color tone between the exposed image and the original or with no difference in the color density between them, irrespective of the kind of the scene of the original, may be attained only by the image forming method of the present invention.

EXAMPLE 2

Preparation of Emulsion (a):

3.3 g of sodium chloride and 24 ml of 1N sulfuric acid were added to an aqueous 3% solution of lime-processed gelatin. To the resulting solution were added an aqueous solution containing 0.2 mol of silver nitrate and an aqueous solution containing 0.2 mol of sodium chloride and 15 μg of rhodium trichloride, with strong stirring at 56° C., and they were blended. Subsequently, an aqueous solution containing 0.79 mol of silver nitrate and an aqueous solution containing 0.79 mol of sodium chloride and 4.2 mg of potassium ferrocyanide were added thereto also with strong stirring at 56° C., and they were blended. 5 minutes after the addition of the aqueous silver nitrate solution and the aqueous alkali halide solution, $2\times10^{-4}$ mol of (Dye-F) was added thereto at 50° C. After 15 minutes, a copolymer of isobutene/monosodium maleate was added to the emulsion formed, and this was subjected to flocculation by rinsing with water for de-salting. Further, 90.0 g of lime-processed gelatin was added thereto, and the pH and pAg values of the emulsion were adjusted to 6.6 and 7.2, respectively. Further, 0.01 mol, as silver nitrate, of fine silver bromide grains (grain size: 0.05 μm) and an aqueous solution containing 0.8 mg of potassium hexachloroiridate(IV) were added thereto with strong stirring, and they were blended. Further, $1\times10^{-5}$ mol/mol of Ag of a sulfur sensitizing agent, $1\times10^{-5}$ mol/mol of Ag of a chloroauric acid and 0.2 g/mol of Ag of nucleic acid were added thereto, whereby the emulsion was subjected to optimum chemical sensitization at 50° C.

The silver chlorobromide grains of the Emulsion (a) thus prepared were observed with an electron microscope, and the shape, the grain size and the grain size distribution of the grains were obtained from the electromicroscopic photograph. The silver halide grains were cubic and had a grain size of 0.52 μm and a coefficient of variation of the grain size of 0.08. The grain size was represented by the mean value of the diameter of the circle corresponding to the projected area of the grain; and the coefficient of variation was represented by the value as obtained by dividing the standard deviation of the grain size by the mean grain size.

Next, the halogen composition of the emulsion grains was determined by measuring the X-ray diffraction of the silver halide crystals. The angle of diffraction from the (200) plane was measured in detail, using a mono-chromatic CuKα ray as a ray source. The diffraction line from crystals having a uniform halogen composition gives a single peak, while the diffraction line from crystals having a localized phase having a different halogen composition gives plural peaks corresponding to the different halogen compositions. From the angle of diffraction of each peak thus measured, the lattice constant was calculated out, on the basis of which the halogen composition of the silver halide constituting the crystal was determined. The result of determining the Silver Chlorobromide Emulsion (a) in this way indicated that the emulsion had a main peak for 100% silver chloride along with an additional broad diffraction pattern having a center at 70% silver chloride (30% silver bromide) with an extending toe to about 60% silver chloride (40% silver bromide).

Preparation of Emulsions (b) and (c):

Emulsion (b) was prepared in the same manner as Emulsion (a), except that $4\times10^{-5}$ mol of (Dye-G) was used in place of (Dye-F); and Emulsion (c) was prepared in the same manner as Emulsion (a), except that $2\times10^{-5}$ mol of (Dye-H) was used in place of (Dye-F).

Dyes used above are mentioned below.

(Dye-F):

1/1 mixture (by mol) of the following compounds:

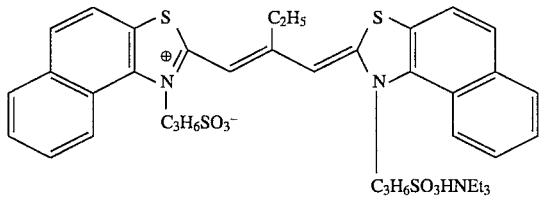

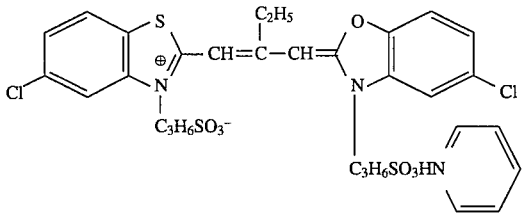

(Dye-G):

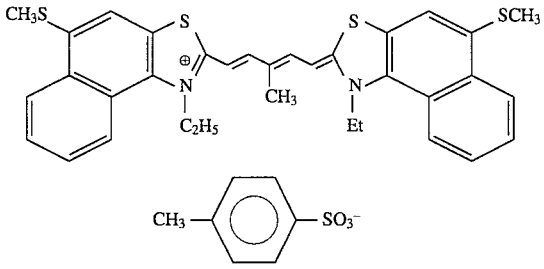

(Dye-H):

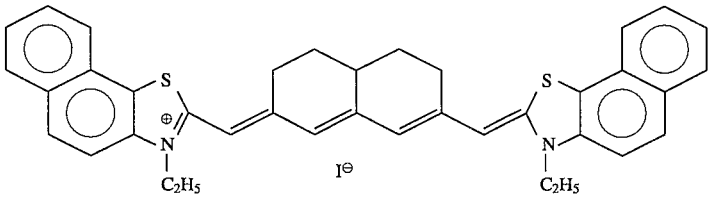

Emulsions (a), (b) and (c) each contained $5.0\times10^{-4}$ mol, per mol of silver halide, of 1-(5-methylureido-phenyl)-5-mercaptotetrazole.

Emulsions (b) and (c) each contained the following (Cpd-16) and (Cpd-17) in an amount of $3\times10^{-3}$ mol and $1\times10^{-3}$ mol, respectively, mol per mol of silver halide.

(Cpd-16):

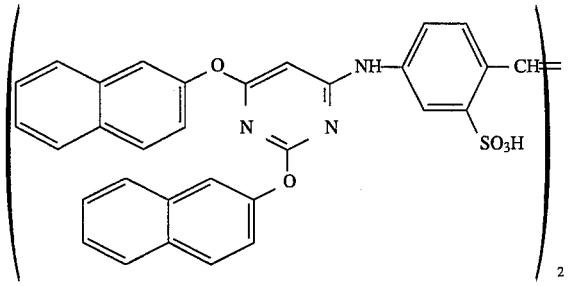

(Cpd-17):

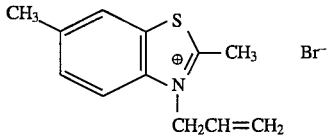

Preparation of Photographic Material Sample No. 201:

Photographic Material Sample No. 201 was prepared in the same manner as Sample No. 101 of Example 1, except that Emulsions (A), (B) and (C) used in the first, third and fifth layers, respectively, of sample No. 101 were replaced by Emulsion (a) (for the first layer), Emulsion (b) (for the third layer) and Emulsion (c) (for the fifth layer), respectively.

The Sample No. 201 was composed of a red-sensitive yellow-coloring layer (first layer) having a spectral sensitivity peak at about 670 nm, a red-sensitive magenta-coloring layer (third layer) having a spectral sensitivity peak at about 740 nm and an infrared-sensitive cyan-coloring layer (fifth layer) having a spectral sensitivity peak at about 830 nm.

Preparation of Photographic Material Samples Nos. 202 to 207:

Photographic Material Sample Nos. 202 to 207 were prepared in the same manner as in preparation of Sample No. 201, except that the dyes of the amounts as indicated in Table 4 below were added to the second layer and the fourth layer. The dyes of the amounts were divided into two portions and were separately added to the second and fourth layers in every sample.

TABLE 4

| Sample No. | Dyes Added and Their Amounts (mg/m$^2$) |
|---|---|
| 201 | |
| 202 | Dye-6 (2.5); Dye-7 (6.0) |
| 203 | Dye-5 (20.0); Dye-6 (2.5); Dye-7 (6.0) |
| 204 | Dye-5 (30.0); Dye-6 (5.0); Dye-7 (15.0) |
| 205 | Dye-5 (40.0); Dye-6 (5.0); Dye-7 (25.0) |
| 206 | Dye-5 (20.0); Dye-7 (20.0); Dye-8 (35.0) |
| 207 | Dye-5 (20.0); Dye-7 (25.0); Dye-9 (20.0) |

Dyes used above are mentioned below.

(Dye-5):

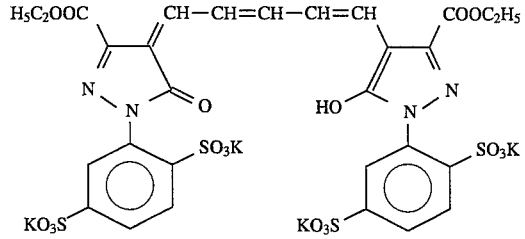

(Dye-6):

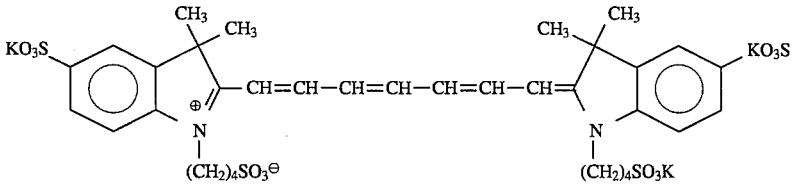

(Dye-7):

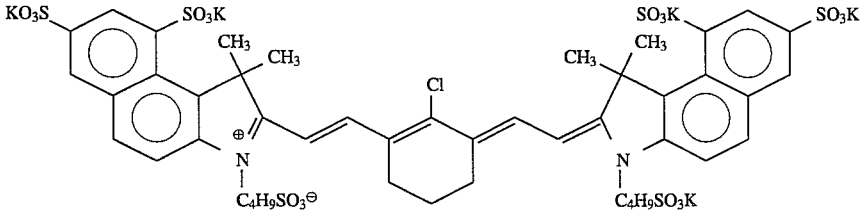

(Dye-8):

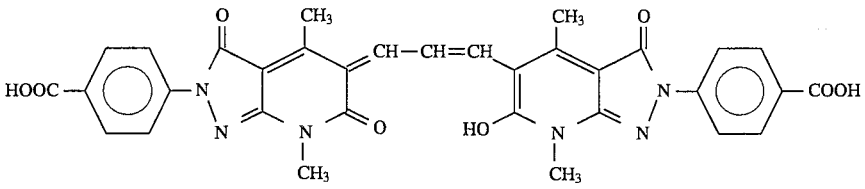

(Dye-9):

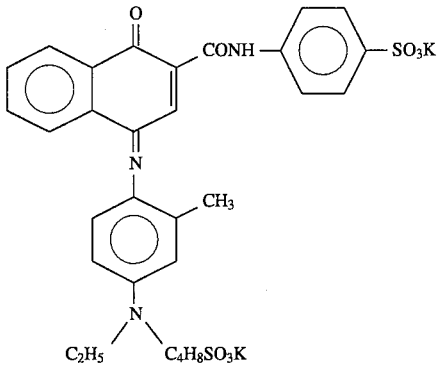

The same image forming device as that employed in Example 1 was used for exposing Sample Nos. 201 to 207, except that the light sources were exchanged for an AlGaInP semiconductor laser (Toshiba's TOLD 9211 Model; oscillation wavelength of about 670 nm), a GaAlAs semiconductor laser (Sharp's LT030MDO Model; oscillation wavelength of about 750 nm) and a GaAlAs semiconductor laser (Sharp's LT015MDO Model; oscillation wavelength of about 830 nm). Using the same image data (that is, scene (1) and scene (2)) as used in Example 1, Sample Nos. 201 to 207 were exposed in the same manner as in Example 1 at the varying four exposure speeds. Then, the exposed samples were developed. The developed samples were tested in the same manner as in Example 1. The test results are shown in Table 5 below.

TABLE 4

| Sample | Reflectivity of Sample (at LD wavelength) | | | Difference in Color Tone between Original and Image Formed: Scene (1) (exposure speed) | | | | Scene (2) (exposure speed) | | | | |
|---|---|---|---|---|---|---|---|---|---|---|---|---|
| No. | 670 nm | 750 nm | 830 nm | (a) | (b) | (c) | (d) | (a) | (b) | (c) | (d) | Remarks |
| 201 | 85% | 90% | 90% | Δ | Δ | O | O | X | X | Δ | O | comparative sample |
| 202 | 75 | 44 | 38 | Δ | O | O | O | X | X | O | O | comparative sample |
| 203 | 40 | 43 | 38 | O | O | O | O | X | Δ | O | O | comparative sample |
| 204 | 29 | 28 | 29 | O | O | O | O | O | O | O | O | sample of the invention |
| 205 | 9 | 22 | 15 | O | O | O | O | O | O | O | O | sample of the invention |
| 206 | 13 | 18 | 25 | O | O | O | O | O | O | O | O | sample of the invention |
| 207 | 16 | 28 | 19 | O | O | O | O | O | O | O | O | sample of the invention |

From the results obtained, it is noted that the A-4 size photographic material samples of the present invention were well exposed within one second or so by high-speed scanning exposure requiring an exposure time of less than $1\times10^{-7}$ second per pixel. However, it is also noted that if a photographic material having a reflectivity of more than 30% is applied to such high-speed scanning exposure, the image formed often involves a problem that the color tone of the image is different from that of the original, depending upon the scene of the original. In particular, the problem is noticeable from the image of an original of a scene comprising letters and lines. On the contrary, in long-time scanning exposures requiring more than $1\times10^{-7}$ second, the difference in the color tone between the original and the image from it has almost no relation to the reflectivity of the photographic material and all the tested samples had the reproducibility of almost faithfully reproducing an image from the original. In such long-time scanning exposures, however, from several seconds to nearly 10 seconds are needed for exposing one A-4 size photographic material sample, and the long-time scanning exposures are lacking in terms of rapid processability.

From the results, it is understood that rapid exposures with no difference in the color tone between the exposed image and the original or with no difference in the color density between them, irrespective of the kind of the scene of the original, may be attained only by the image forming method of the present invention.

EXAMPLE 3

Photographic Material Sample Nos. 101 to 107 and Nos. 201 to 207 as prepared in Examples 1 and 2, respectively, were exposed in the manner as indicated in Examples 1 and 2, respectively. The exposed samples were then continuously processed with a paper processing machine in accordance with the process mentioned below, until replenisher in an amount two times as large as the tank capacity was replenished to the processing tank. After the running test, the exposed samples were processed with the same machine, using the processing solutions as fatigued by the running test. The processed samples were tested in the same manner as in Example 1 and Example 2. The test results were the same as those in Examples 1 and 2, respectively.

Development Process:

| Step | Temperature | Time | Amount of Replenisher(*) | Capacity of Tank |
|---|---|---|---|---|
| Color Development | 35° C. | 20 sec | 60 ml | 2 liters |
| Bleach-fixation | 30 to 35° C. | 20 sec | 60 ml | 2 liters |
| Rinsing (1) | 30 to 35° C. | 10 sec | — | 1 liter |
| Rinsing (2) | 30 to 35° C. | 10 sec | — | 1 liter |
| Rinsing (3) | 30 to 35° C. | 10 sec | 120 ml | 1 liter |
| Drying | 70 to 80° C. | 20 sec | | |

(*)The amount of replenisher was per $m^2$ of the sample being processed. Rinsing was effected by 3-tank countercurrent system from rinsing (3) to rinsing (1).

Processing solutions used above are mentioned below.

Color Developer:

| | Tank Solution | Replenisher |
|---|---|---|
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 4.9 g | |
| Potassium Carbonate | 25 g | 37 g |
| 4-Amino-3-methyl-N-ethyl-N-(3-hydroxypropyl)aniline Di-p-toluenesulfonate | 12.8 g | 19.8 g |
| N,N-bis(carboxymethyl)-hydrazine | 5.5 g | 7.0 g |
| Brightening Agent (WHITEX 4B, product of Sumitomo Chemical Co.) | 1.0 g | 2.0 g |
| Water to make | 1000 ml | 1000 ml |
| pH (at 25° C.) | 10.05 | 10.45 |

Bleach-fixing Solution:

The tank solution and the replenisher were the same.

| | |
|---|---|
| Water | 400 ml |
| Ammonium Thiosulfate (700 g/liter) | 100 ml |
| Sodium Sulfite | 7 g |
| Ammonium Ethylenediaminetetraacetato/Iron(III) | 55 g |
| Disodium Ethylenediaminetetraacetate | 5 g |
| Ammonium Bromide | 40 g |
| Water to make | 1000 ml |
| pH (at 25° C.) | 6.0 |

Rinsing Solution:

The tank solution and the replenisher were the same.

Ion-exchanged water having calcium and magnesium content of each 3 ppm or less was used.

As explained in detail in the above, simple and rapid scanning exposure and development of photographic materials is possible by the image forming method of the present invention to give photographic images free from fluctuation of the color density and the color tone irrespective of the conditions of the objective scenes.

While the invention has been described in detail and with reference to specific embodiments thereof, it will be apparent to one skilled in the art that various changes and modifications can be made therein without departing from the spirit and scope thereof.

What is claimed is:

1. An image forming method, in which a silver halide photographic material having on a waterproofing resin coated support containing 14 wt % or more of $TiO_2$ in the resin one or more light-sensitive layers each containing surface latent image forming silver halide emulsion grains where at least one light-sensitive layer has been spectrally sensitized to the oscillating wavelength of a laser beam to be used to expose the photographic material, the quantity of the reflection light from the photographic material at the oscillating wavelength of the laser beam being 30% or less of the quantity of the incident light to the same, is exposed for a period of exposure time, per pixel, of $1\times10^{-7}$ second or less with a scanning exposure device equipped with an optical modulator capable of varying the quantity of light in stages, and is then developed in a developing composition containing a developing agent.

2. An image forming method, in which a silver halide color photographic material having on a waterproofing resin coated support containing 14 wt % or more of $TiO_2$ in the resin at least three different silver halide light-sensitive layers each having a different color-sensitivity and each containing any of yellow, magenta or cyan-coloring couplers where the silver halide emulsion in at least one light-sensitive layer is a surface latent image forming high silver chloride emulsion having a silver chloride content of 95 mol % or more and having been spectrally sensitized to the oscillating wavelength of a laser beam to be used to expose the photographic material, the quantity of the reflection light from the photographic material at the oscillating wavelength of the laser beam being 30% or less of the quantity of the incident light to the same, is exposed for a period of exposure time, per pixel, of $1\times10^{-7}$ second or less with a scanning exposure device equipped with an optical modulator capable of varying the quantity of light in stages and is then developed in a developing composition containing a developing agent.

3. The image forming method as claimed in claim 2, in which the high silver chloride emulsion having a silver chloride content of 95 mol % or more and having been spectrally sensitized to the oscillating wavelength of a laser beam used to expose said material, has a localized silver bromide phase.

4. The image forming method as claimed in claim 2, wherein the silver halide emulsion grains are high silver chloride emulsion grains which have been doped with $10^{-9}$ mol or more, per mol of silver halide of the emulsion, of an ion of at least one metal selected from the group consisting of Groups VIII and IIb of the Periodic Table, lead and thallium.

5. The image forming method as claimed in claim 1, in which the exposure time, per pixel, for exposing the material with a scanning exposure device equipped with an optical modulator capable of varying the quantity of light in stages is $5\times10^{-8}$ second or less per pixel.

6. The image forming method as claimed in claim 1, in which the optical modulator is a wave-guide acousto-optical modulator or a wave-guide electro-optical modulator.

7. The image forming method as claimed in claim 1, in which the time for color development is 25 seconds or less and the total processing time from color development to drying is 90 seconds or less.

8. The image forming method of claim 1, in which the optical modulator is capable of varying the intensity of light in stages of at least six bits.

9. The image forming method of claim 2, in which the optical modulator is capable of varying the intensity of light in stages of at least six bits.

* * * * *